US011913729B2

(12) United States Patent
Andou et al.

(10) Patent No.: US 11,913,729 B2
(45) Date of Patent: Feb. 27, 2024

(54) HEAT EXCHANGER

(71) Applicant: DAIKIN INDUSTRIES, LTD., Osaka (JP)

(72) Inventors: Tooru Andou, Osaka (JP); Tomohiro Nagano, Osaka (JP); Hirokazu Fujino, Osaka (JP); Yoshiyuki Matsumoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/154,202

(22) Filed: Jan. 13, 2023

(65) Prior Publication Data

US 2023/0168043 A1 Jun. 1, 2023

Related U.S. Application Data

(63) Continuation of application No. PCT/JP2021/026070, filed on Jul. 12, 2021.

(30) Foreign Application Priority Data

Jul. 17, 2020 (JP) ..... 2020-123313

(51) Int. Cl.
*F28D 7/16* (2006.01)
*B21D 53/06* (2006.01)
(Continued)

(52) U.S. Cl.
CPC ..... *F28D 7/16* (2013.01); *B21D 53/06* (2013.01); *F28F 1/04* (2013.01); *F28F 9/02* (2013.01)

(58) Field of Classification Search
CPC ..... F28D 7/16; F28F 1/04; F28F 9/02; B21D 53/06
(Continued)

(56) References Cited

U.S. PATENT DOCUMENTS 857,060 A * 6/1907 Heizmann ..... F22G 7/10 165/175
3,757,855 A * 9/1973 Kun ..... F28D 1/0391 29/890.039
(Continued)

FOREIGN PATENT DOCUMENTS

CN 101537435 A 9/2009
CN 107806777 A 3/2018
(Continued)

OTHER PUBLICATIONS

International Preliminary Report on Patentability issued in corresponding PCT/JP2021/026070 dated Jan. 17, 2023 (7 pages).
(Continued)

*Primary Examiner* — Tho V Duong
*Assistant Examiner* — Raheena R Malik
(74) *Attorney, Agent, or Firm* — Osha Bergman Watanabe & Burton LLP

(57) ABSTRACT

A heat exchanger includes: refrigerant channels that extend in a first direction, are disposed along a second direction intersecting with the first direction, and are disposed along a third direction intersecting with the first direction and the second direction; and heat transfer tubes defining the refrigerant channels. One or both of a size of an outer edge and a size of an inner edge of the heat transfer tubes are different between a first position and a second position in the first direction. Outer surfaces of the heat transfer tubes each include a protrusion that protrudes in a direction intersecting with the first direction, and is in contact with an outer surface of one of the heat transfer tubes adjacent thereto in the second direction. The protrusion includes a concave portion extending along the third direction.

16 Claims, 19 Drawing Sheets

(51) Int. Cl.
*F28F 1/04* (2006.01)
*F28F 9/02* (2006.01)

(58) Field of Classification Search
USPC ..... 165/175
See application file for complete search history.

(56) References Cited

U.S. PATENT DOCUMENTS 4,014,962 A * 3/1977 del Notario ..... B01J 19/32 261/DIG. 11
4,119,825 A * 10/1978 Taylor ..... H05B 6/42 219/676
4,183,402 A * 1/1980 Cotter ..... F28D 1/0316 165/DIG. 473
4,206,806 A * 6/1980 Togashi ..... F28F 9/0221 165/910
4,217,887 A * 8/1980 Hoffman ..... F24S 80/30 165/173
4,353,350 A * 10/1982 Albrecht ..... F24B 1/1886 126/522
4,541,891 A * 9/1985 Leatherman ..... B29C 65/18 264/315
4,589,481 A * 5/1986 Mansson ..... F28D 7/024 165/910
5,099,576 A 3/1992 Shinmura
5,101,887 A 4/1992 Kado
5,251,693 A * 10/1993 Zifferer ..... F28F 1/06 165/177
5,318,113 A * 6/1994 Potier ..... F28D 1/05366 165/173
5,375,654 A * 12/1994 Hougland ..... F28F 13/12 165/181
6,688,378 B2 * 2/2004 O'Donnell ..... F28F 1/42 138/40
7,017,651 B1 * 3/2006 Wilson ..... H01L 23/473 165/47
7,255,155 B2 * 8/2007 O'Donnell ..... F24H 9/0026 165/179
8,459,342 B2 * 6/2013 O'Donnell ..... F28F 13/08 165/177
8,701,750 B2 * 4/2014 Oh ..... F28D 1/05391 165/174
10,753,687 B2 * 8/2020 Plummer ..... F28D 7/087
10,914,524 B2 * 2/2021 Yanik ..... F28F 9/262
11,073,344 B2 * 7/2021 Williams ..... F28F 1/06
11,614,286 B2 * 3/2023 Yanik ..... F28F 1/04 165/175
2002/0124999 A1 * 9/2002 Chiba ..... F28F 17/005 165/176
2004/0251244 A1 * 12/2004 Torigoe ..... F28F 21/06 219/202
2013/0146264 A1 * 6/2013 Kim ..... F28F 3/042 165/181
2019/0360754 A1 * 11/2019 Yanik ..... F28D 1/053

FOREIGN PATENT DOCUMENTS

JP S58-165468 U 11/1983
JP S61-175774 U 11/1986
JP H03-46757 U 4/1991
JP H03-112657 U 11/1991
JP 2005-90806 A 4/2005
JP 2008-188602 A 8/2008
JP 2012154492 A 8/2012
JP 2016-151392 A 8/2016
JP 2019-116907 A 7/2019
JP 2019-132518 A 8/2019
WO 2005/073655 A1 8/2005

OTHER PUBLICATIONS

Notice of Reasons for Refusal issued in corresponding Japanese Patent Application No. 2020-123313 dated Feb. 1, 2022 (6 pages).
Decision to Grant issued in corresponding Japanese Patent Application No. 2020-123313 dated Aug. 9, 2022 (5 pages).
International Search Report issued in corresponding International Application No. PCT/JP2021/026070 dated Sep. 7, 2021 (6 pages).
Extended European Search Report issued in corresponding European Patent Application No. 21841525.5, dated Nov. 8, 2023. (6 pages).

* cited by examiner

HEAT EXCHANGER

CROSS-REFERENCE TO RELATED APPLICATIONS

This is a continuation application of International Patent Application No. PCT/JP2021/026070, filed on Jul. 12, 2021, and claims priority to Japanese Patent Application No. 2020-123313, filed on Jul. 17, 2020. The contents of these priority applications are incorporated herein by reference.

TECHNICAL FIELD

The present disclosure relates to a heat exchanger, and more particularly, to a heat exchanger that does not have heat transfer fins.

BACKGROUND

There is a conventionally known heat exchanger, without heat transfer fins, in which a plurality of refrigerant channels extending in a first direction is arranged in a second direction intersecting with the first direction and is also arranged in a third direction intersecting with the first direction and the second direction. For example, Patent Literature 1 (International Publication No. 2005/073655) discloses a heat exchanger, without no heat transfer fins, in which a plurality of refrigerant channels extending in a first direction is arranged in a third direction and a plurality of flat heat transfer tubes is arranged in a second direction orthogonal to the first direction and the third direction.

In the heat exchanger disclosed in Patent Literature 1 (International Publication No. 2005/073655), each of the heat transfer tubes is configured to have a concave and convex shape along the third direction when the heat transfer tube is viewed along the first direction so that the heat transfer efficiency may be improved.

SUMMARY

According to one or more embodiments, a heat exchanger includes a plurality of refrigerant channels extending in a first direction, and the plurality of refrigerant channels is arranged along a second direction intersecting with the first direction and is arranged along a third direction intersecting with the first direction and the second direction. The heat exchanger includes a plurality of heat transfer tubes defining the refrigerant channels. At least one of a size of an outer edge or a size of an inner edge of the heat transfer tube is different between a first position and a second position in the first direction.

DETAILED DESCRIPTION

Figure 1:
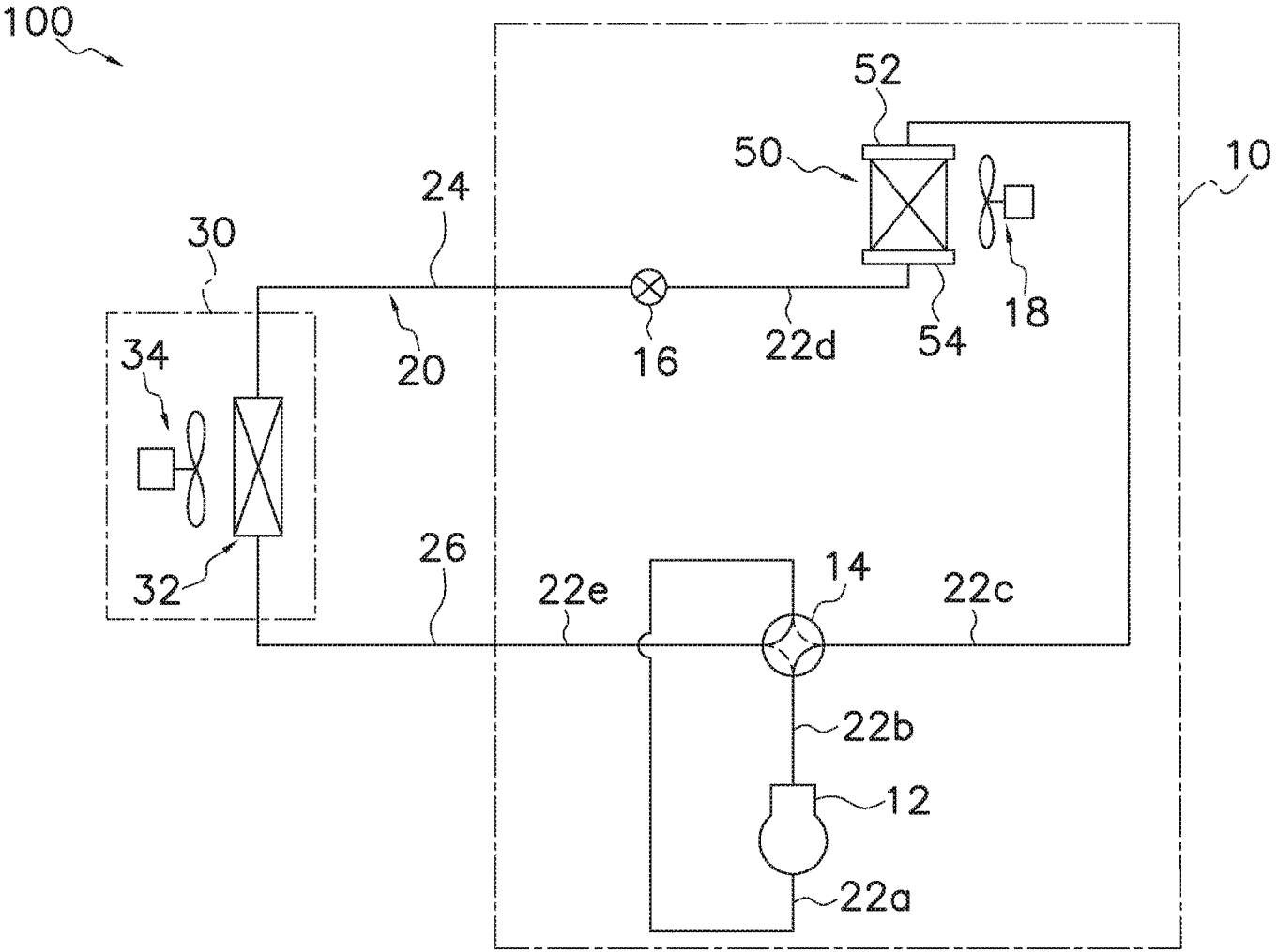
FIG. 1 is a schematic configuration diagram of an air conditioning apparatus using a heat exchanger according to the present disclosure as a heat-source heat exchanger.

Embodiments of a heat exchanger according to the present disclosure will be described with reference to the drawings. In the drawings, the same or similar members are denoted by the same reference numerals throughout the drawings.

First Embodiments

A heat-source heat exchanger 50 according to first embodiments of the heat exchanger of the present disclosure and an air conditioning apparatus 100 including the heat-source heat exchanger 50 will be described.

In this description, the heat exchanger according to the present disclosure is described by taking, as an example, a case where the heat exchanger according to the present disclosure is used as a heat-source heat exchanger of the air conditioning apparatus 100, but the application of the heat exchanger according to the present disclosure is not limited to heat-source heat exchangers of air conditioning apparatuses. For example, the heat exchanger according to the present disclosure may be used as heat-source heat exchangers of refrigeration cycle apparatuses other than air conditioning apparatuses, such as hot water supply apparatuses, floor heating apparatuses, and low-temperature devices such as refrigerators and freezers. Further, the application of the heat exchanger according to the present disclosure is not limited to heat-source heat exchangers, but it may be used as utilization heat exchangers of refrigeration cycle apparatuses (for example, a utilization heat exchanger 32 of the air conditioning apparatus 100 described below).

(1) Air Conditioning Apparatus

First, the air conditioning apparatus 100 including the heat-source heat exchanger 50 will be described with reference to FIG. 1. FIG. 1 is a schematic configuration diagram of the air conditioning apparatus 100 using the heat exchanger according to the present disclosure as the heat-source heat exchanger 50.

The air conditioning apparatus 100 is an example of a vapor-compression refrigeration cycle apparatus. The air conditioning apparatus 100 uses a refrigeration cycle to perform cooling or heating of an air-conditioning target space.

As illustrated in FIG. 1, the air conditioning apparatus 100 primarily includes one heat source unit 10 and one utilization unit 30. Further, the numbers of the heat source units 10 and the utilization units 30 are not limited to one, and the air conditioning apparatus 100 may include the plurality of heat source units 10 and/or the plurality of utilization units 30.

In the air conditioning apparatus 100, the heat source unit 10 and the utilization unit 30 are coupled with a gas-refrigerant connection pipe 26 and a liquid-refrigerant connection pipe 24 at the installation site of the air conditioning apparatus 100 to form a refrigerant circuit 20 where the refrigerant circulates. Further, the air conditioning apparatus 100 according to one or more embodiments is a separate air conditioning apparatus where the heat source unit 10 and the utilization unit 30 are separate units, but the air conditioning apparatus where the heat exchanger according to the present disclosure is used may be an all-in-one air conditioning apparatus where the heat source unit and the utilization unit are housed in one casing.

According to one or more embodiments, the refrigerant sealed in the refrigerant circuit 20 is an HFC refrigerant such as R32 or R410A. However, the type of refrigerant is not limited to the HFC refrigerant and may be, for example, an HFO refrigerant such as HFO1234yf, HFO1234ze(E), or a mixed refrigerant thereof. Further, the type of refrigerant may be a natural refrigerant such as $CO_2$ gas.

Details of the heat source unit 10 and the utilization unit 30 and the flow of the refrigerant in the refrigerant circuit 20 during operation of the air conditioning apparatus 100 will be described below.

(1-1) Heat Source Unit

The heat source unit 10 primarily includes a compressor 12, a channel switching mechanism 14, the heat-source heat exchanger 50, an expansion mechanism 16, and a heat source fan 18 (see FIG. 1).

Further, the heat source unit 10 includes a suction pipe 22*a*, a discharge pipe 22*b*, a first gas refrigerant pipe 22*c*, a liquid refrigerant pipe 22*d*, and a second gas refrigerant pipe 22*e* as pipes constituting a part of the refrigerant circuit 20 (see FIG. 1). The suction pipe 22*a* couples the channel switching mechanism 14 and a suction port of the compressor 12. The discharge pipe 22*b* couples a discharge port of the compressor 12 and the channel switching mechanism 14. The first gas refrigerant pipe 22*c* couples the channel switching mechanism 14 and a gas header 52, described below, of the heat-source heat exchanger 50. The liquid refrigerant pipe 22*d* couples a liquid header 54, described below, of the heat-source heat exchanger 50 and the liquid-refrigerant connection pipe 24. The expansion mechanism 16 is provided in the liquid refrigerant pipe 22*d*. The second gas refrigerant pipe 22*e* couples the channel switching mechanism 14 and the gas-refrigerant connection pipe 26.

The compressor 12 is a device that suctions a low-pressure gas refrigerant in the refrigeration cycle from the suction pipe 22*a*, compresses it by a compression mechanism (not illustrated), and discharges it to the discharge pipe 22*b*. Various types of compressors such as rotary compressors and scroll compressors may be used as the compressor 12. A motor (not illustrated) of the compressor 12 that drives the compression mechanism is an inverter motor whose rotational speed is variable. The number of rotations of the motor is controlled as appropriate by a control unit, not illustrated, of the air conditioning apparatus 100 in accordance with the operating state of the air conditioning apparatus 100. However, the motor of the compressor 12 may be a constant-speed motor.

The channel switching mechanism 14 is a mechanism that switches the flow direction of the refrigerant in the refrigerant circuit 20. According to one or more embodiments, the channel switching mechanism 14 is a four-way switching valve. However, the channel switching mechanism 14 is not limited to a four-way switching valve, and may include a plurality of electromagnetic valves and refrigerant pipes to achieve switching of the flow direction of the refrigerant as described below.

During the cooling operation of the air conditioning apparatus 100, the channel switching mechanism 14 switches the flow direction of the refrigerant in the refrigerant circuit 20 so that the refrigerant discharged from the compressor 12 is delivered to the heat-source heat exchanger 50. Specifically, during the cooling operation of the air conditioning apparatus 100, the channel switching mechanism 14 causes the suction pipe 22*a* and the second gas refrigerant pipe 22*e* to communicate with each other and causes the discharge pipe 22*b* and the first gas refrigerant pipe 22*c* to communicate with each other (see the solid lines in FIG. 1).

Conversely, during the heating operation of the air conditioning apparatus 100, the channel switching mechanism 14 switches the flow direction of the refrigerant in the refrigerant circuit 20 so that the refrigerant discharged from the compressor 12 is delivered to the utilization heat exchanger 32. Specifically, during the heating operation of the air conditioning apparatus 100, the channel switching mechanism 14 causes the suction pipe 22*a* and the first gas refrigerant pipe 22*c* to communicate with each other and causes the discharge pipe 22*b* and the second gas refrigerant pipe 22*e* to communicate with each other (see the broken lines in FIG. 1).

The heat-source heat exchanger 50 is an example of a heat exchanger according to the present disclosure. In the heat-source heat exchanger 50, the heat is exchanged between the refrigerant flowing through a heat transfer tube 60, described below, of the heat-source heat exchanger 50 and an external fluid (air according to one or more embodiments). During the cooling operation of the air conditioning apparatus 100, the heat-source heat exchanger 50 functions as a radiator (condenser) for the refrigerant so that the refrigerant flowing through the heat transfer tube 60 exchanges heat with the external fluid (releases heat to the external fluid) and is cooled. During the heating operation of the air conditioning apparatus 100, the heat-source heat exchanger 50 functions as an evaporator for the refrigerant so that the refrigerant flowing through the heat transfer tube 60 exchanges heat with the external fluid (absorbs heat from the external fluid)

and is heated. Details of the structure, and the like, of the heat-source heat exchanger 50 will be described below.

The expansion mechanism 16 is a mechanism that decompresses the refrigerant. The expansion mechanism 16 according to one or more embodiments is an electronic expansion valve whose opening degree is adjustable. The opening degree of the electronic expansion valve is controlled as appropriate by a control unit, not illustrated, of the air conditioning apparatus 100 in accordance with the operating state of the air conditioning apparatus 100. The expansion mechanism 16 is not limited to an electronic expansion valve, but may be a thermostatic expansion valve using a thermostatic tube. Further, the expansion mechanism 16 is not limited to an expansion valve whose opening degree is adjustable, but may be a capillary tube.

The heat source fan 18 is a device that supplies the air taken from the outside of the heat source unit 10 to the heat-source heat exchanger 50 to promote heat exchange between the refrigerant and the air (external fluid) in the heat-source heat exchanger 50. The heat source fan 18 generates the flow of air that flows in through an air inlet (not illustrated) formed in a casing (not illustrated) of the heat source unit 10, passes through the heat-source heat exchanger 50, and blows out through an air outlet (not illustrated) formed in the casing of the heat source unit 10. The fan type of the heat source fan 18 may be selected as appropriate. A motor (not illustrated) that drives the heat source fan 18 is an inverter motor whose rotational speed is variable. The number of rotations of the motor is controlled as appropriate by a control unit, not illustrated, of the air conditioning apparatus 100 in accordance with the operating state. Furthermore, the motor that drives the heat source fan 18 may be a constant-speed motor.

(1-2) Utilization Unit

The utilization unit 30 is a unit that exchanges heat between the refrigerant and the air in the air-conditioning target space to air-condition the air-conditioning target space. The utilization unit 30 primarily includes the utilization heat exchanger 32 and a utilization fan 34 (see FIG. 1).

In the utilization heat exchanger 32, the heat is exchanged between the refrigerant flowing through a heat transfer tube (not illustrated) of the utilization heat exchanger 32 and the air in the air-conditioning target space. The utilization heat exchanger 32 is, for example, a fin-and-tube heat exchanger including a plurality of heat transfer tubes and a plurality of heat transfer fins attached to the heat transfer tubes. However, as described above, the finless heat exchanger (including no heat transfer fins) according to the present disclosure may also be used as the utilization heat exchanger 32.

During the cooling operation of the air conditioning apparatus 100, the utilization heat exchanger 32 functions as an evaporator for the refrigerant so that the refrigerant flowing through the heat transfer tube of the utilization heat exchanger 32 exchanges heat with the air in the air-conditioning target space (absorbs heat from the air in the air-conditioning target space) and is heated. In other words, during the cooling operation of the air conditioning apparatus 100, the air in the air-conditioning target space is cooled by the refrigerant flowing through the heat transfer tube of the utilization heat exchanger 32. Conversely, during the heating operation of the air conditioning apparatus 100, the utilization heat exchanger 32 functions as a radiator (condenser) for the refrigerant so that the refrigerant flowing through the heat transfer tube of the utilization heat exchanger 32 exchanges heat with the air in the air-conditioning target space (releases heat to the air in the air-conditioning target space) and is cooled. In other words, during the heating operation of the air conditioning apparatus 100, the air in the air-conditioning target space is heated by the refrigerant flowing through the heat transfer tube of the utilization heat exchanger 32.

The utilization fan 34 is a device that supplies the air taken from the air-conditioning target space to the utilization heat exchanger 32 to promote heat exchange between the refrigerant in the utilization heat exchanger 32 and the air in the air-conditioning target space. The utilization fan 34 generates the flow of air that flows in through an air inlet (not illustrated) formed in a casing (not illustrated) of the utilization unit 30 from the air-conditioning target space, passes through the utilization heat exchanger 32, and blows out through a blow-out outlet (not illustrated) formed in the casing of the utilization unit 30 to the air-conditioning target space. The fan type of the utilization fan 34 may be selected as appropriate. A motor (not illustrated) that drives the utilization fan 34 is an inverter motor whose rotational speed is variable. The number of rotations of the motor is controlled as appropriate by a control unit, not illustrated, of the air conditioning apparatus 100 in accordance with the operating state. The motor that drives the utilization fan 34 may be a constant-speed motor.

(1-3) Flow of Refrigerant in Air Conditioning Apparatus

In the air conditioning apparatus 100, during the cooling operation and the heating operation, the refrigerant circulates in the refrigerant circuit 20 as described below.

(1-3-1) During Cooling Operation

During the cooling operation, the channel switching mechanism 14 is in the state indicated by the solid line in FIG. 1 so that the discharge side of the compressor 12 communicates with the gas side of the heat-source heat exchanger 50 and the suction side of the compressor 12 communicates with the gas side of the utilization heat exchanger 32.

When the compressor 12 is driven in this state, the low-pressure gas refrigerant in the refrigeration cycle flowing in from the suction pipe 22*a* is compressed by the compression mechanism of the compressor 12 to become a high-pressure gas refrigerant. The high-pressure gas refrigerant discharged from the compressor 12 flows into the heat-source heat exchanger 50 via the discharge pipe 22*b*, the channel switching mechanism 14, and the first gas refrigerant pipe 22*c*. The high-pressure gas refrigerant exchanges heat with the air supplied by the heat source fan 18 in the heat-source heat exchanger 50 to be cooled down and condensed and finally becomes a high-pressure liquid refrigerant via a gas-liquid two phase state. The high-pressure liquid refrigerant flowing out of the heat-source heat exchanger 50 is delivered to the expansion mechanism 16. The low-pressure gas-liquid two phase refrigerant decompressed in the expansion mechanism 16 flows through the liquid refrigerant pipe 22*d* and the liquid-refrigerant connection pipe 24 and flows into the liquid side of the utilization heat exchanger 32. The refrigerant flowing into the utilization heat exchanger 32 exchanges heat with the air in the air-conditioning target space to evaporate, becomes a low-pressure gas refrigerant, and flows out of the utilization heat exchanger 32. The low-pressure gas refrigerant flowing out of the utilization heat exchanger 32 is again suctioned into the compressor 12 via the gas-refrigerant connection pipe 26, the second gas refrigerant pipe 22*e*, the channel switching mechanism 14, and the suction pipe 22*a*.

(1-3-2) During Heating Operation

During the heating operation, the channel switching mechanism 14 is in the state indicated by the broken line in FIG. 1 so that the discharge side of the compressor 12 communicates with the gas side of the utilization heat exchanger 32 and the suction side of the compressor 12 communicates with the gas side of the heat-source heat exchanger 50.

When the compressor 12 is driven in this state, the low-pressure gas refrigerant in the refrigeration cycle flowing in from the suction pipe 22*a* is compressed by the compression mechanism of the compressor 12 to become a high-pressure gas refrigerant. The high-pressure gas refrigerant discharged from the compressor 12 flows into the utilization heat exchanger 32 via the discharge pipe 22*b*, the channel switching mechanism 14, the second gas refrigerant pipe 22*e*, and the gas-refrigerant connection pipe 26. The high-pressure gas refrigerant exchanges heat with the air in the air-conditioning target space in the utilization heat exchanger 32 to be cooled and condensed and becomes a high-pressure liquid refrigerant. The high-pressure liquid refrigerant flowing out of the utilization heat exchanger 32 flows through the liquid-refrigerant connection pipe 24 and the liquid refrigerant pipe 22*d* and is delivered to the expansion mechanism 16. The high-pressure liquid refrigerant delivered to the expansion mechanism 16 is decompressed when passing through the expansion mechanism 16. The low-pressure liquid-phase or gas-liquid two phase refrigerant decompressed in the expansion mechanism 16 flows into the heat-source heat exchanger 50. The refrigerant flowing into the heat-source heat exchanger 50 is heated and evaporated by heat exchange with the air supplied by the heat source fan 18, becomes a low-pressure gas refrigerant, and flows out of the heat-source heat exchanger 50. The low-pressure gas refrigerant flowing out of the heat-source heat exchanger 50 is again suctioned into the compressor 12 via the first gas refrigerant pipe 22*c*, the channel switching mechanism 14, and the suction pipe 22*a*.

(2) Heat-Source Heat Exchanger

The heat-source heat exchanger 50 will be described with reference to FIGS. 2 to 8.

Figure 2:
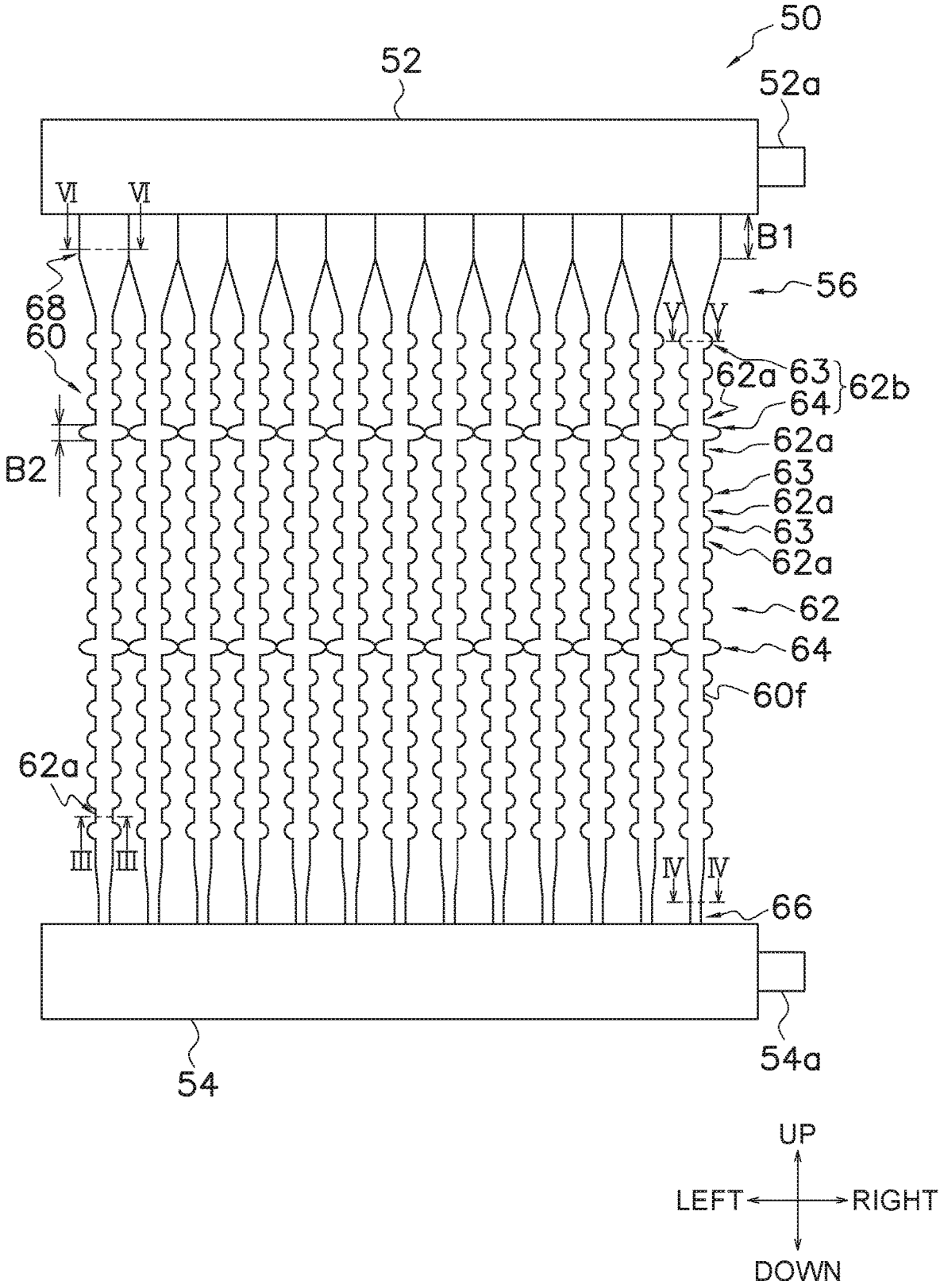
FIG. 2 is a schematic front view of the heat-source heat exchanger according to first embodiments.
Figure 3:
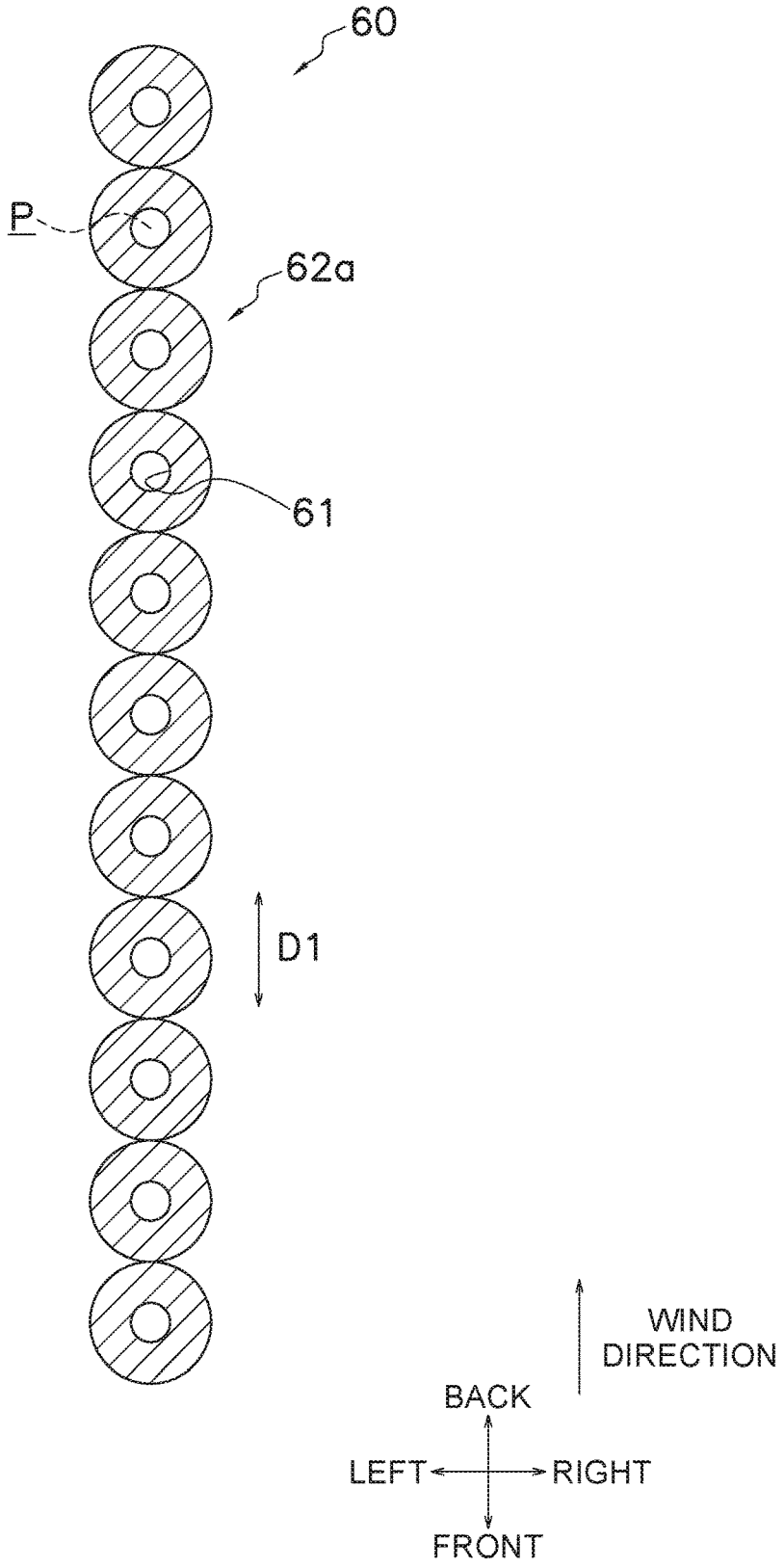
FIG. 3 is a schematic cross-sectional view of a heat transfer tube taken along the line in FIG. 2.
Figure 4:
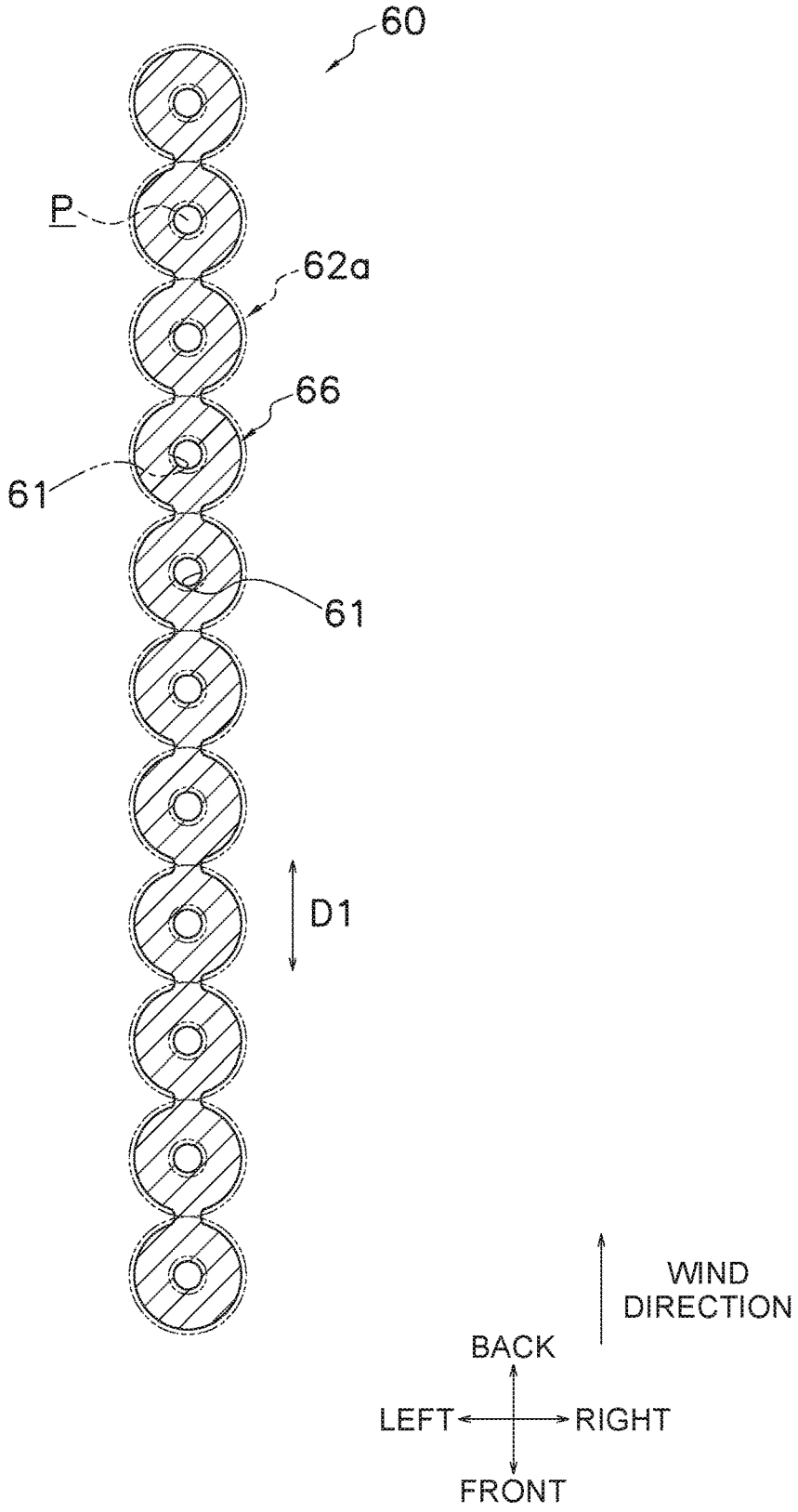
FIG. 4 is a schematic cross-sectional view of the heat transfer tube taken along the line IV-IV in FIG. 2.
Figure 5:
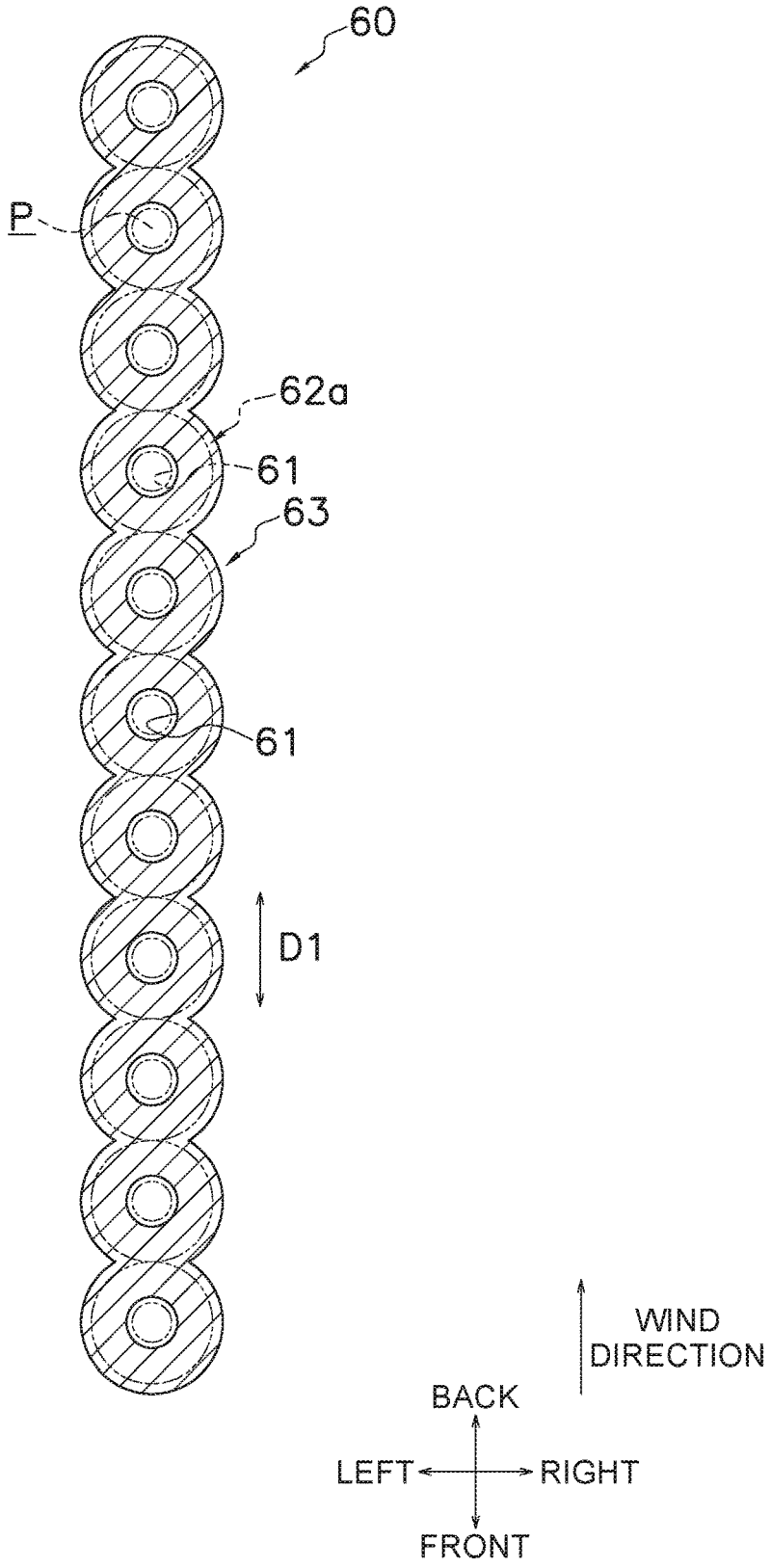
FIG. 5 is a schematic cross-sectional view of the heat transfer tube taken along the line V-V in FIG. 2.
Figure 6:
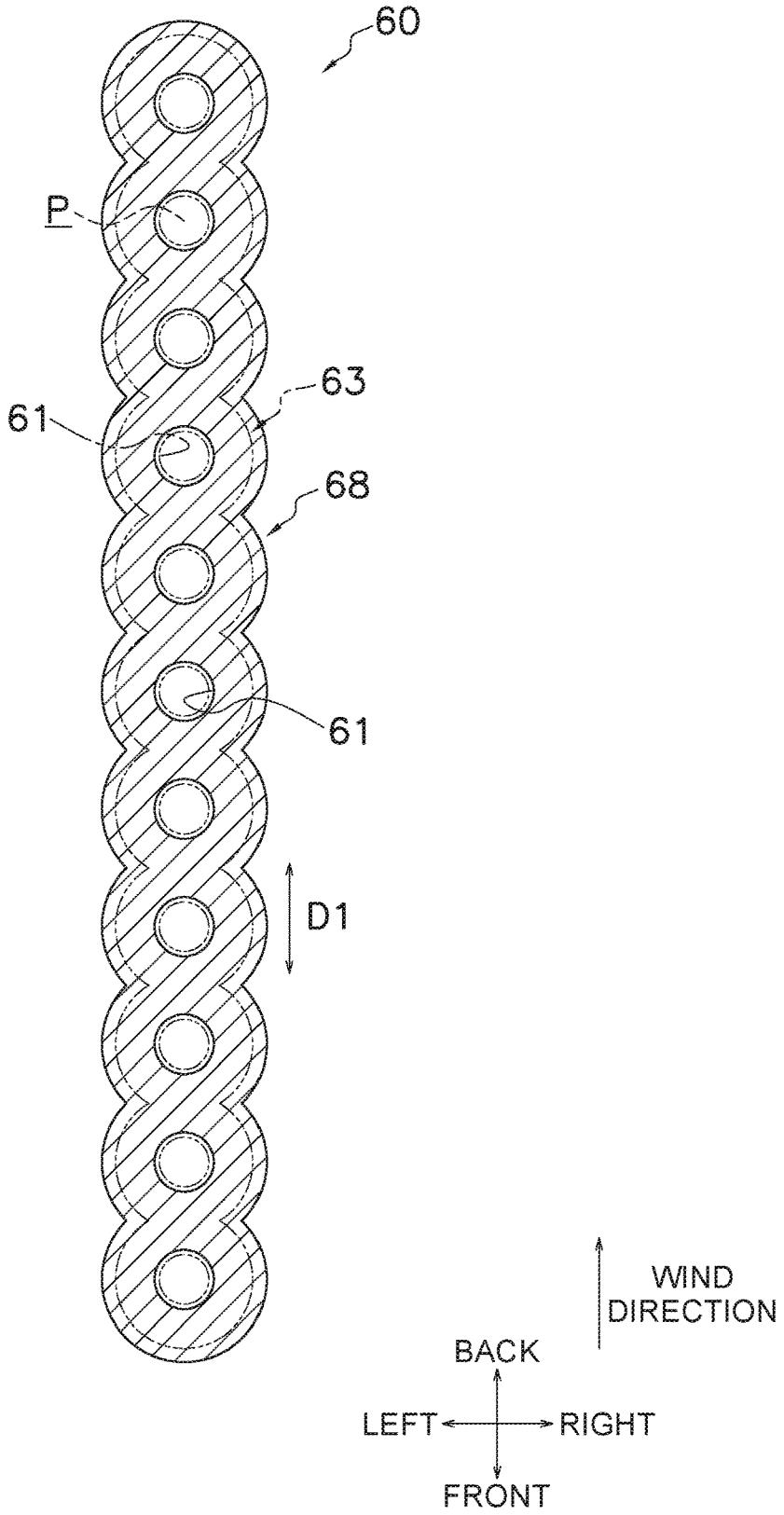
FIG. 6 is a schematic cross-sectional view of the heat transfer tube taken along the line VI-VI in FIG. 2.
Figure 7:
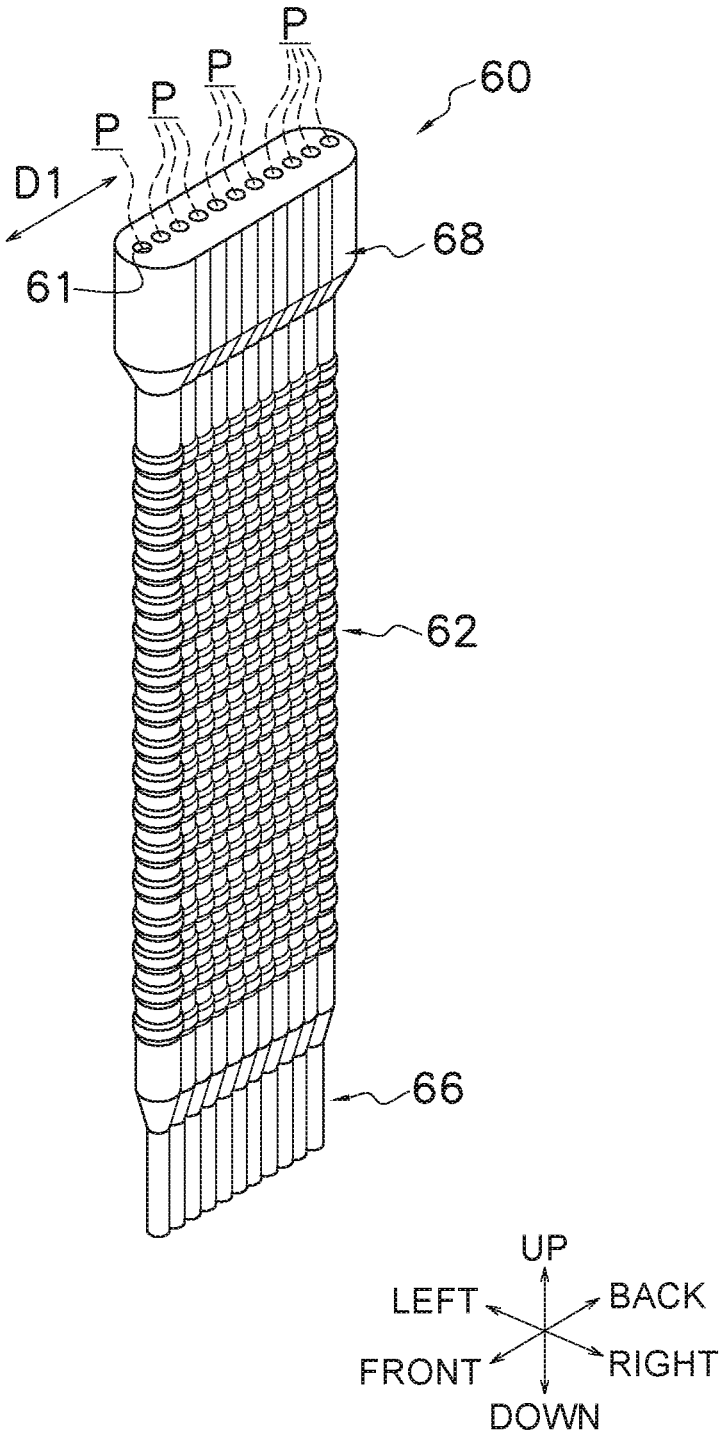
FIG. 7 is a schematic perspective view of the heat transfer tube of the heat-source heat exchanger in FIG. 2.
Figure 8:
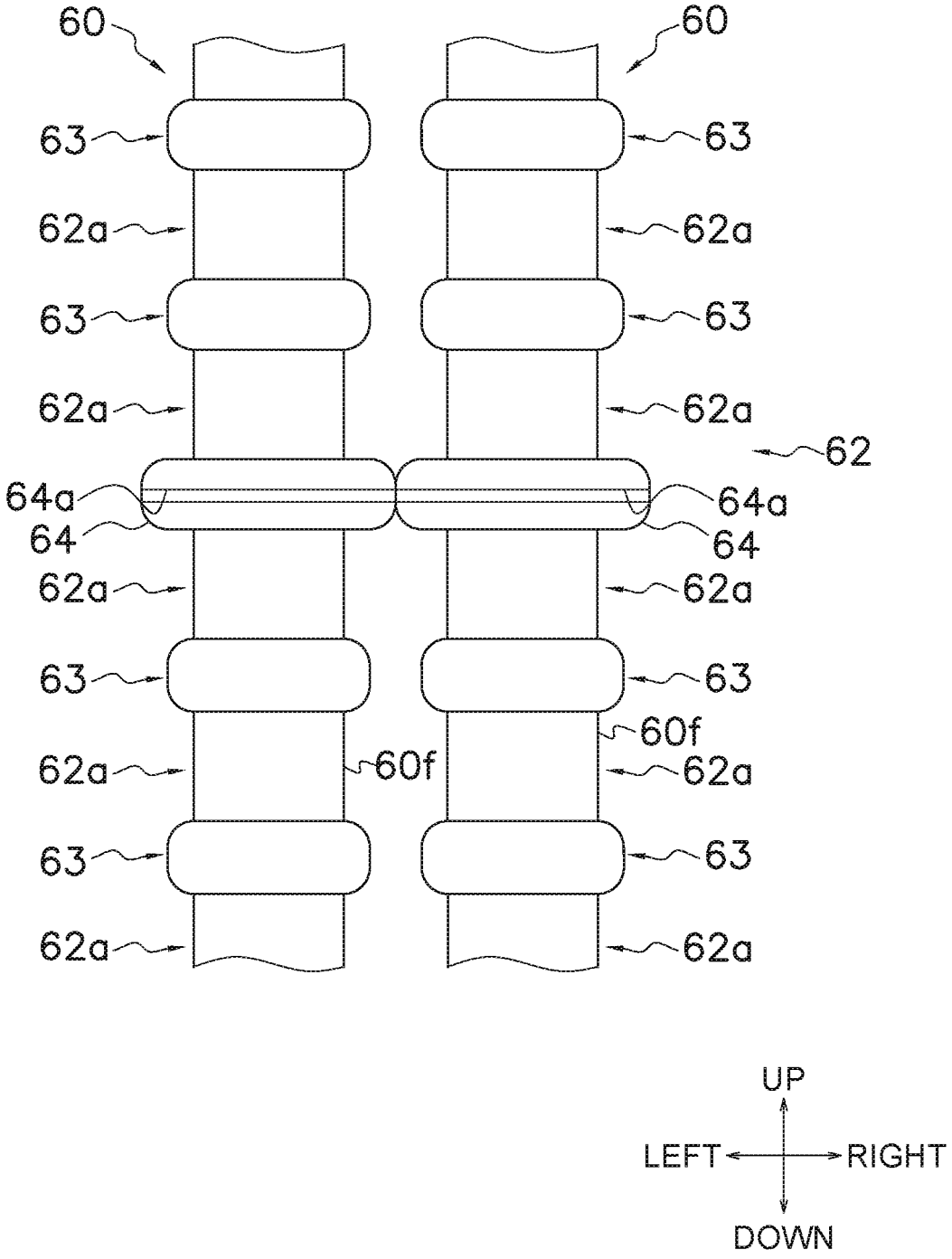
FIG. 8 is an enlarged schematic front view of part of the heat-source heat exchanger to illustrate the contact state between the heat transfer tubes and the arrangement of a first portion and a second portion in a first region of the heat transfer tube in the heat-source heat exchanger in FIG. 2.

FIG. 2 is a schematic front view of the heat-source heat exchanger 50. FIG. 3 is a schematic cross-sectional view of the heat transfer tube 60 taken along the line in FIG. 2. FIG. 4 is a schematic cross-sectional view of the heat transfer tube 60 taken along the line IV-IV in FIG. 2. FIG. 5 is a schematic cross-sectional view of the heat transfer tube 60 taken along the line V-V in FIG. 2. FIG. 6 is a schematic cross-sectional view of the heat transfer tube 60 taken along the line VI-VI in FIG. 2. FIG. 7 is a schematic perspective view of the heat transfer tube 60 of the heat-source heat exchanger 50. FIG. 8 is an enlarged schematic front view of part of the heat-source heat exchanger 50. FIG. 8 is a diagram illustrating the contact state between the heat transfer tubes 60 and the arrangement of a first portion 62*a* and a second portion 62*b* in a first region 62 of the heat transfer tube 60 in the heat-source heat exchanger 50.

FIGS. 2 to 8 are schematic views illustrating the characteristics of the heat-source heat exchanger 50. Therefore, FIGS. 2 to 8 do not limit the shape, size, quantity, and the like, of the whole and part of the heat-source heat exchanger 50.

In the following description, the expressions such as up, down, left, right, front (front side), and back (back side) may be used to describe directions, positions, and the like. Unless otherwise specified, the directions and positions indicated by these expressions follow the arrows in the drawings. Furthermore, the up-down direction, the right-left direction, and the front-back direction according to one or more embodiments correspond to a first direction, a second direction, and a third direction in the claims, respectively.

In the description below, the expressions such as horizontal, vertical, parallel, perpendicular, and same, and the like may be used; however, these expressions represent not only being in horizontal, vertical, parallel, perpendicular, and same states, and the like, in a precise sense, but also being substantially in horizontal, vertical, parallel, perpendicular, and same states, and the like.

The heat-source heat exchanger 50 primarily includes the gas header 52, the liquid header 54, and a heat exchange unit 56. The heat exchange unit 56 includes the plurality of heat transfer tubes 60. One end of each of the heat transfer tubes 60 is coupled to the gas header 52. According to one or more embodiments, an upper end of each of the heat transfer tubes 60 is coupled to the gas header 52. Further, one end of each of the heat transfer tubes 60 is coupled to the liquid header 54. According to one or more embodiments, a lower end of each of the heat transfer tubes 60 is coupled to the liquid header 54.

The heat-source heat exchanger 50 is a finless heat exchanger that does not use heat transfer fins. In the heat-source heat exchanger 50, primarily in the heat transfer tube 60, heat is exchanged between the refrigerant and an external fluid (air according to one or more embodiments) supplied by the heat source fan 18.

The heat-source heat exchanger 50 is made of, for example, aluminum or an aluminum alloy. Furthermore, the material of the heat-source heat exchanger 50 is not limited to aluminum or an aluminum alloy, and may be, for example, a magnesium alloy. Materials other than those described as examples may be selected as the material of the heat-source heat exchanger 50.

Further, the materials of the gas header 52, the liquid header 54, and the heat transfer tubes 60 of the heat exchange unit 56 may be different from each other. However, from the viewpoint of electrolytic corrosion prevention, the materials of the gas header 52, the liquid header 54, and the heat transfer tubes 60 of the heat exchange unit 56 may be identical.

(2-1) Gas Header

The gas header 52 is a hollow member in which an internal space is formed. The gas header 52 linearly extends with a predetermined direction as its longitudinal direction. According to one or more embodiments, for convenience of explanation, the longitudinal direction of the gas header 52 is defined as a right-left direction.

The gas header 52 is a member having functions to split the refrigerant flowing in from the first gas refrigerant pipe 22*c* into the heat transfer tubes 60, and to merge the refrigerants flowing in from the heat transfer tubes 60 and flow the refrigerant into the first gas refrigerant pipe 22*c*. Specific descriptions will be given.

The gas header 52 has an internal space formed therein, in which the refrigerant flows from the first gas refrigerant pipe 22*c* and the heat transfer tubes 60.

One end of each of the heat transfer tubes 60 of the heat exchange unit 56 is coupled to the gas header 52. In particular, according to one or more embodiments, the upper end of each of the heat transfer tubes 60 of the heat exchange unit 56 is coupled to the gas header 52. The heat transfer tubes 60 are coupled to the gas header 52 such that the heat transfer tubes 60 are arranged along the longitudinal direction of the gas header 52. The heat transfer tubes 60 are secured to the gas header 52 by, for example, brazing. The heat transfer tubes 60 are coupled to the gas header 52, and thus refrigerant channels P, described below, of the heat transfer tubes 60 communicate with the internal space of the gas header 52.

The gas header 52 includes a coupling portion 52*a* that is coupled to the first gas refrigerant pipe 22*c*. The internal space of the gas header 52 communicates with the first gas refrigerant pipe 22*c* via the coupling portion 52*a*.

As a result of this configuration, when the heat-source heat exchanger 50 functions as a condenser, the gas header 52 splits the refrigerant, flowing into the internal space from the first gas refrigerant pipe 22*c*, into the refrigerant channels P defined in the heat transfer tubes 60. Furthermore, when the heat-source heat exchanger 50 functions as an evaporator, the gas header 52 merges the refrigerants flowing into the internal space from the heat transfer tubes 60 and flows the refrigerant into the first gas refrigerant pipe 22*c*.

(2-2) Liquid Header

The liquid header 54 is a hollow member in which an internal space is formed. The liquid header 54 linearly extends with a predetermined direction as its longitudinal direction. Specifically, similarly to the gas header 52, the liquid header 54 linearly extends with the right-left direction as its longitudinal direction. The liquid header 54 is provided at a position immediately under the gas header 52 and corresponding to the gas header 52. In short, the heat-source heat exchanger 50 is installed in a casing, not illustrated, of the heat source unit 10 in such a posture that the heat transfer tubes 60 coupled to the gas header 52 and the liquid header 54 extend in a vertical direction.

The liquid header 54 is a member having functions to split the refrigerant flowing in from the liquid refrigerant pipe 22*d* into the heat transfer tubes 60 and merge the refrigerants flowing in from the heat transfer tubes 60 and flow the refrigerant into the liquid refrigerant pipe 22*d*. Specific descriptions will be given.

The liquid header 54 has an internal space formed therein, in which the liquid refrigerant flows from the liquid refrigerant pipe 22*d* and the heat transfer tubes 60.

One end (the end opposite to the side coupled to the gas header 52) of each of the heat transfer tubes 60 of the heat exchange unit 56 is coupled to the liquid header 54. In particular, according to one or more embodiments, the lower end of each of the heat transfer tubes 60 of the heat exchange unit 56 is coupled to the liquid header 54. The heat transfer tubes 60 are coupled to the liquid header 54 such that the heat transfer tubes 60 are arranged along the longitudinal direction of the liquid header 54. Each of the heat transfer tubes 60 having one end coupled to the liquid header 54 and the other end coupled to the gas header 52 extends in the vertical direction. The heat transfer tubes 60 are secured to the liquid header 54 by, for example, brazing. The heat transfer tubes 60 are coupled to the liquid header 54, and thus the refrigerant channels P, described below, of the heat transfer tubes 60 communicate with the internal space of the liquid header 54.

The liquid header 54 includes a coupling portion 54*a* that is coupled to the liquid refrigerant pipe 22*d*. The internal space of the liquid header 54 communicates with the liquid refrigerant pipe 22*d* via the coupling portion 54*a*.

As a result of this configuration, when the heat-source heat exchanger 50 functions as a condenser, the liquid header 54 merges the liquid refrigerants flowing into the internal space from the heat transfer tubes 60 and flows the liquid refrigerant into the liquid refrigerant pipe 22*d*. Further, when the heat-source heat exchanger 50 functions as an evaporator, the liquid header 54 splits the liquid refrigerant or the gas-liquid two phase refrigerant, flowing into the internal space from the liquid refrigerant pipe 22*d*, into the refrigerant channels P defined in the heat transfer tubes 60.

(2-3) Heat Exchange Unit

The heat exchange unit 56 includes the heat transfer tubes 60. In the state where the heat-source heat exchanger 50 is installed, each of the heat transfer tubes 60 extends in the up-down direction (the first direction) as its longitudinal direction. In each of the heat transfer tubes 60, the channel (the refrigerant channel P) of the refrigerant extending in the longitudinal direction is defined.

According to one or more embodiments, each of the heat transfer tubes 60 is a flat multi-hole tube in which the refrigerant channels P are formed. In the state where the heat-source heat exchanger 50 is installed, the refrigerant channels P extending along the vertical direction are formed in each of the heat transfer tubes 60 (see FIG. 7). Further, the number of refrigerant channels P formed in each of the heat transfer tubes 60 is not limited to the number of refrigerant channels P illustrated in the drawing.

When each of the heat transfer tubes 60 is cut along the plane orthogonal to the longitudinal direction of the heat transfer tubes 60 and a certain direction is defined as a longitudinal direction (hereafter, this direction is referred to as a cross-sectional longitudinal direction D1), each of the heat transfer tubes 60 has a flat cross-section with a small width in a direction orthogonal to the cross-sectional longitudinal direction D1. Further, in the following description, unless otherwise specified, the expression "the cross-section of the heat transfer tube 60" refers to the cross-section when the heat transfer tube 60 is cut along the plane orthogonal to the longitudinal direction (the up-down direction in the state where the heat-source heat exchanger 50 is installed).

Further, according to one or more embodiments, the cross-section of each of the heat transfer tubes 60 has a shape in which a plurality of circular tubes is arranged in the cross-sectional longitudinal direction D1, as illustrated in FIG. 3, for example. Further, the cross-section illustrated in FIG. 3 is merely a schematic illustration of the cross-section of the heat transfer tube 60 and is not a specific limitation on the cross-sectional shape of the heat transfer tube 60. Moreover, the cross-sectional shape of the heat transfer tube 60 is not limited to the shape illustrated in FIG. 3, and its outer shape may be a flat square shape. However, in terms of heat-exchange efficiency, the cross-section of each of the heat transfer tubes 60 may have a concave and convex shape along the cross-sectional longitudinal direction D1, as illustrated in FIG. 3, for example.

In the cross-section of each of the heat transfer tubes 60, a plurality of holes 61 defining the refrigerant channels P are arranged side by side along the cross-sectional longitudinal direction D1 as illustrated in FIG. 3, for example. Further, in the drawing, the shape of the hole 61 is circular, but the shape of the hole 61 may be other than a circular shape (e.g., a square shape).

According to one or more embodiments, the heat transfer tube 60 is attached to the gas header 52 and the liquid header 54 in such a posture that the direction in which the cross-sectional longitudinal direction D1 of the heat transfer tube 60 extends matches the front-back direction. Here, the front-back direction along the cross-sectional longitudinal direction D1 of the heat transfer tube 60 substantially matches the flow direction of the air generated by the heat source fan 18. For example, in the heat source unit 10, the heat source fan 18 is disposed in front of the heat-source heat exchanger 50 to blow air backward toward the heat-source heat exchanger 50. As the cross-sectional longitudinal direction D1 of the heat transfer tube 60 as a flat multi-hole tube matches the flow direction of the air generated by the heat source fan 18, the air delivered by the heat source fan 18 may be efficiently brought into contact with the side surface of the heat transfer tube 60 extending along the cross-sectional longitudinal direction D1 while air flow resistance of the heat-source heat exchanger 50 is suppressed, and thus a high heat exchange efficiency may be achieved.

Further, in the heat-source heat exchanger 50, the heat transfer tubes 60 are arranged side by side in a direction intersecting with the cross-sectional longitudinal direction D1. Specifically, the heat transfer tubes 60 are attached to the gas header 52 and the liquid header 54 so as to be arranged in a direction orthogonal to the cross-sectional longitudinal direction D1. In other words, according to one or more embodiments, the heat transfer tubes 60 are arranged side by side in the right-left direction.

As a result of this configuration, in the heat-source heat exchanger 50, the refrigerant channels P, extending in the first direction, are arranged along the second direction intersecting with the first direction and are arranged along the third direction intersecting with the first direction and the second direction. Specifically, in the heat-source heat exchanger 50, the refrigerant channels P, extending in the vertical direction, are arranged along the right-left direction orthogonal to the vertical direction and are arranged along the front-back direction orthogonal to the vertical direction and the right-left direction.

The heat transfer tube 60 of the heat-source heat exchanger 50 according to the present disclosure includes portions in which at least one of the size of the outer edge or the size of the inner edge is different in the up-down direction in which the refrigerant channel P extends. In other words, in each of the heat transfer tubes 60, at least one of the size of the outer edge or the size of the inner edge is different between a first position and a second position (different from the first position) in the up-down direction in which the refrigerant channel P extends.

The size of the outer edge of the heat transfer tube 60 at a certain position in the up-down direction in which the refrigerant channel P extends refers to the length of the outer edge of the cross-section when the heat transfer tube 60 is cut at that position along the plane orthogonal to the up-down direction. The size of the inner edge of the heat transfer tube 60 at a certain position in the up-down direction in which the refrigerant channel P extends refers to the total length of the outer periphery of the hole 61 when the heat transfer tube 60 is cut at that position along the plane orthogonal to the up-down direction.

A specific description will be given below for changes in the size of the outer edge of the heat transfer tube 60 and/or the size of the inner edge of the heat transfer tube 60 in the up-down direction (the first direction in the claims).

Each of the heat transfer tubes 60 includes the first region 62, a second region 66, and a third region 68 having different size characteristics of the outer edge and/or the inner edge in the up-down direction. The positions of the first region 62, the second region 66, and the third region 68, the shapes of the heat transfer tube 60 in the first region 62, the second region 66, and the third region 68, and the like, will be described below.

(2-3-1) Arrangement of First to Third Regions

The positions of the heat transfer tube 60 where the first region 62, the second region 66, and the third region 68 are provided will be described.

The second region 66 is a lower region of the heat transfer tube 60. In other words, the second region 66 is a region of an end portion of the heat transfer tube 60 on the side coupled to the liquid header 54. The heat transfer tube 60 is coupled to the liquid header 54 in the portion of the second region 66 of the heat transfer tube 60. The second region 66 of the heat transfer tube 60 is an example of a liquid header coupling portion in the claims. Although the range where the second region 66 is present is not limited, for example, the second region 66 is provided in a range above the lower end of the heat transfer tube 60 by a length corresponding to 10% of the length of the heat transfer tube 60 in the up-down direction.

The third region 68 is an upper region of the heat transfer tube 60. In other words, the third region 68 is a region of an end portion of the heat transfer tube 60 on the side coupled to the gas header 52. The heat transfer tube 60 is coupled to the gas header 52 in the portion of the third region 68 of the heat transfer tube 60. The third region 68 of the heat transfer tube 60 is an example of a gas header coupling portion in the claims. Although the range where the third region 68 is present is not limited, for example, the third region 68 is provided in a range under the upper end of the heat transfer tube 60 by a length corresponding to 10% of the length of the heat transfer tube 60 in the up-down direction.

The first region 62 is provided between the second region 66 and the third region 68 in the up-down direction. The first region 62 may be provided at least in a central portion of the heat transfer tube 60 in the up-down direction. Here, the central portion of the heat transfer tube 60 refers to a range having a length corresponding to 25% of the length of the heat transfer tube 60 in the up-down direction downward and upward from the center of the heat transfer tube 60 in the up-down direction.

The first region 62 and the second region 66 may be arranged adjacent to each other in the up-down direction. Furthermore, a region that does not belong to either the first region 62 or the second region 66 described below may be present between the first region 62 and the second region 66. Further, similarly, the first region 62 and the third region 68 may be arranged adjacent to each other in the up-down direction, or a region that does not belong to either the first region 62 or the third region 68 described below may be present between the first region 62 and the third region 68.

(2-3-2) Shapes of Heat Transfer Tube in First to Third Regions

The shapes of the heat transfer tube 60 in the first region 62, the second region 66, and the third region 68 will be described.

(2-3-2-1) First Region

The heat transfer tube 60 in the first region 62 is provided with the first portion 62*a* and the second portion 62*b*. The second portion 62*b* includes a non-contact portion 63 and a contact portion 64. The contact portion 64 is an example of a protrusion and a second protrusion in the claims.

The non-contact portion 63 and the contact portion 64 in the second portion 62*b* protrude in a direction intersecting with the up-down direction with respect to the first portion 62*a*. The non-contact portion 63 and the contact portion 64 protrude at least in the right-left direction, i.e., toward the adjacent heat transfer tube 60, with respect to the first portion 62*a*.

The non-contact portion 63 and the contact portion 64 have different protruding amounts with respect to the first portion 62*a*. Specifically, the protruding amount of the contact portion 64 with respect to the first portion 62*a* is larger than the protruding amount of the non-contact portion 63 with respect to the first portion 62*a*. Further, the non-contact portion 63 is not in contact with the outer surface 60*f* of the adjacent heat transfer tube 60, while the contact portion 64 is in contact with the outer surface 60*f* of the heat transfer tube 60 adjacent thereto in the right-left direction.

Furthermore, the non-contact portion 63 and the contact portion 64 are different from each other in that the contact portion 64 is provided with a concave portion 64*a* and the non-contact portion 63 is not provided with the concave portion 64*a*. The concave portion 64*a* includes a groove portion that is concave in a direction away from the heat transfer tube 60 in contact with the contact portion 64 and that extends along the front-back direction.

In the first region 62, the first portion 62*a* and the second portion 62*b* (the non-contact portion 63 or the contact portion 64) protruding in a direction intersecting with the up-down direction with respect to the first portion 62*a* are alternately formed along the up-down direction in the heat transfer tube 60 (see FIG. 2). The first portion 62*a* (concave portion) and the second portion 62*b* (convex portion) are alternately provided along the up-down direction in the first region 62 of the heat transfer tube 60 so that the outer surface 60*f* of the first region 62 of the heat transfer tube 60 has concave and convex along the up-down direction (see FIG. 2).

As the non-contact portion 63 protrudes in the direction intersecting with the up-down direction with respect to the first portion 62*a*, the size of the outer edge of the non-contact portion 63 is thus larger than the size of the outer edge of the first portion 62*a*, as illustrated in FIG. 5. Further, in FIG. 5, the cross-section of the first portion 62*a* is indicated in a dashed-two dotted line, and the size of the outer edge of the non-contact portion 63 is indicated in a solid line. Although not illustrated, the size of the outer edge of the contact portion 64 is also larger than the size of the outer edge of the first portion 62*a*. Further, the size of the outer edge of the contact portion 64 is larger than the size of the outer edge of the non-contact portion 63.

Further, as illustrated in FIG. 5, the size of the inner edge of the non-contact portion 63 is also larger than the size of the inner edge of the first portion 62*a*. Similarly, the size of the inner edge of the contact portion 64 is also larger than the size of the inner edge of the first portion 62*a*. In other words, the size of the hole 61 in the non-contact portion 63 and the contact portion 64 is larger than the size of the hole 61 in the first portion 62*a*. In short, the channel area of the refrigerant channel P in the non-contact portion 63 and the contact portion 64 is larger than the channel area of the refrigerant channel P in the first portion 62*a*.

Next, the positional relationship among the first portion 62*a*, the non-contact portion 63, and the contact portion 64 in the adjacent heat transfer tube 60 in the heat-source heat exchanger 50 according to one or more embodiments will be described.

In the heat-source heat exchanger 50 according to one or more embodiments, all the heat transfer tubes 60 include the first region 62. Further, the first region 62 is provided at the same position in the up-down direction in all the heat transfer tubes 60. Further, in the first region 62 of each of the heat transfer tubes 60, the first portion 62*a*, the non-contact portion 63, and the contact portion 64 are provided at the same positions in the up-down direction. In short, in the heat-source heat exchanger 50 according to one or more embodiments, the first portions 62*a*, the non-contact portions 63, and the contact portions 64 are arranged at the same positions in the up-down direction and arranged side by side in the right-left direction.

In other words, in the heat-source heat exchanger 50 according to one or more embodiments, both of a certain heat transfer tube 60 (referred to as the first heat transfer tube 60) and the heat transfer tube 60 (referred to as the second heat transfer tube 60) adjacent to the first heat transfer tube 60 in the right-left direction include the first region 62. Further, the non-contact portion 63 of the first heat transfer tube 60 and the non-contact portion 63 of the second heat transfer tube 60 are formed at the identical position in the up-down direction.

Moreover, in the heat-source heat exchanger 50 according to one or more embodiments, the contact portion 64 of the first heat transfer tube 60 and the contact portion 64 of the second heat transfer tube 60 are formed at the identical position in the up-down direction. Thus, the contact portion 64 of the first heat transfer tube 60 is in contact with the contact portion 64 of the second heat transfer tube 60 adjacent thereto in the right-left direction.

<Effect of Providing First Region>

The effect of providing the first region 62 in the heat transfer tube 60 will be described.

(a) Improvement in Heat Transfer Coefficient and Suppression of Increase in Pressure Loss in Refrigerant Channel According to one or more embodiments, the first region 62 of the heat transfer tube 60 is formed at least in the central portion of the heat transfer tube 60 in the longitudinal direction (the up-down direction according to one or more embodiments) of the heat transfer tube 60 in which the refrigerant channel P extends. The first region 62 of the heat transfer tube 60 may be formed in a central region of the heat transfer tube 60 (the central portion of the heat transfer tube 60 and the periphery thereof) in the longitudinal direction of the heat transfer tube 60. The central region of the heat transfer tube 60 is a region where heat is actively exchanged between the refrigerant and the external fluid both when the heat-source heat exchanger 50 functions as a condenser and when the heat-source heat exchanger 50 functions as an evaporator. Furthermore, the gas-liquid two phase refrigerant primarily flows in the central region of the heat transfer tube 60 both when the heat-source heat exchanger 50 functions as a condenser and when the heat-source heat exchanger 50 functions as an evaporator.

In the first region 62 of the heat transfer tube 60, the outer surface 60*f* of the heat transfer tube 60 has concave and convex foamed repeatedly thereon along the up-down direction. In other words, in the first region 62 of the heat transfer tube 60, the heat transfer tube 60 repeatedly expands and contracts along the up-down direction. In still other words, in the first region 62 of the heat transfer tube 60, the size of the outer edge of the heat transfer tube 60 repeatedly expands and contracts along the up-down direction. Furthermore, in the first region 62 of the heat transfer tube 60, the size of the inner edge of the heat transfer tube 60 also repeatedly expands and contracts along the up-down direction. In other words, in the first region 62 of the heat transfer tube 60, the area of the refrigerant channel P of the heat transfer tube 60 also repeatedly expands and contracts along the up-down direction.

Since the first region 62, in which the outer edge of the heat transfer tube 60 repeatedly expands and contracts along the up-down direction (the direction in which the refrigerant channel P extends), is provided in the central region of the heat transfer tube 60, i.e., the region where the gas-liquid two phase refrigerant primarily flows, the heat transfer efficiency between the refrigerant and the external fluid may be improved. Further, since the first region 62, in which the size of the inner edge of the heat transfer tube 60 repeatedly expands and contracts along the up-down direction (the direction in which the refrigerant channel P extends), is provided in the central region of the heat transfer tube 60, i.e., in the region where the gas-liquid two phase refrigerant primarily flows, the pressure loss of the refrigerant flowing through the refrigerant channel P may be suppressed.

(b) Suppression of Blockage of Air Channel Due to Frost Formation

When the heat-source heat exchanger is used as an evaporator, frost formation may occur on the heat-source heat exchanger in some operating conditions. Such frost formation is likely to occur in the heat-source heat exchanger, in particular, on the upstream side in the flow direction of the external fluid (air) that exchanges heat with the refrigerant. For example, as in one or more embodiments, when the heat source fan 18, provided in front of the heat-source heat exchanger 50, delivers air toward the heat-source heat exchanger 50 provided behind, frost formation is likely to occur on the front-side end portion of the heat transfer tube 60 of the heat-source heat exchanger 50.

If the first region 62 is not provided in the heat transfer tube 60 and the portions expanding and contracting along the longitudinal direction (the up-down direction) of the heat transfer tube 60 are not provided in the windward-side end portion of the heat transfer tube 60, i.e., if the width of the windward-side end portion of the heat transfer tube 60 in the right-left direction is uniform along the longitudinal direction of the heat transfer tube 60, frost formation occurs substantially uniformly in the windward-side end portion of the heat transfer tube 60. Therefore, a failure, in which the frost adhering to the windward-side end portion of the heat transfer tube 60 block the channel of the air, and the air is not delivered to the leeward side beyond the windward-side end portion of the heat transfer tube 60, may occur at a relatively early timing after the start of operation of the air conditioning apparatus 100.

Conversely, the heat transfer tube 60 according to one or more embodiments has the first region 62, and the first portion 62*a* having a relatively small outer edge and the second portion 62*b* having a relatively large outer edge are provided in the heat transfer tube 60 along the up-down direction. In this way, in case where the outer surface 60*f* of the heat transfer tube 60 has concave and convex repeatedly along the first direction, frost formation on the windward-side end portion of the heat transfer tube 60 is likely to concentrate on the convex portion (i.e., the second portion 62*b*). Therefore, the heat transfer tube 60 according to one or more embodiments may suppress frost formation on the first portion 62*a* of the first region 62 in the windward-side end portion of the heat transfer tube 60 and may at least delay the occurrence of a failure in which frost formation on the windward-side end portion of the heat transfer tube 60 blocks the channel of the air. Therefore, in the air conditioning apparatus 100 using the heat-source heat exchanger 50, the heating operation may continue for a relatively long time without being stopped for defrosting of the heat-source heat exchanger 50.

In particular, according to one or more embodiments, the non-contact portions 63 and the contact portions 64 of the first regions 62 of the adjacent heat transfer tubes 60 are formed at the identical position in the up-down direction. In other words, according to one or more embodiments, the first portions 62*a* of the first regions 62 of the adjacent heat transfer tubes 60 are formed at the identical position in the up-down direction. Therefore, in the heat-source heat exchanger 50 according to one or more embodiments, a relatively large air channel may be ensured between the first portions 62*a* of the first regions 62 of the adjacent heat transfer tubes 60. Therefore, blockage of the air channel due to frost adhering to the windward-side end portion of the heat transfer tube 60 is easily suppressed in particular. Furthermore, from the viewpoint of suppression of blockage of the air channel due to frost (delay in blockage of the air channel due to frost), the second portions 62*b* of the first region 62 of the heat transfer tube 60 may be provided over substantially the entire region of the heat transfer tube 60 in the vertical direction.

<Effect of Providing Contact Portion>

The effect of providing the contact portion 64 in the heat transfer tube 60 will be described.

As described above, the contact portion 64 of the heat transfer tube 60 is in contact with the contact portion 64 of the heat transfer tube 60 adjacent thereto in the right-left direction. As the contact portions 64 of the heat transfer tubes 60 are in contact with each other in this manner, the distance between the heat transfer tubes 60 may be adjusted to a predetermined distance. In other words, as the contact portions 64 of the heat transfer tubes 60 adjacent to each other in the right-left direction are in contact with each other in the heat-source heat exchanger 50, it is possible to suppress the occurrence of the state where the heat transfer tubes 60 adjacent to each other in the right-left direction excessively approach each other or excessively separate from each other. In short, the contact portion 64 of the heat transfer tube 60 functions as a spacer that adjusts the arrangement pitch of the heat transfer tubes 60.

Adjustment of the arrangement pitch between the heat transfer tubes 60 may be achieved by a spacer separate from the heat transfer tube 60 provided between the heat transfer tubes 60. However, the use of the contact portion 64 formed in the heat transfer tube 60 itself as a spacer may reduce the cost of providing a spacer separate from the heat transfer tube 60, the labor cost for attaching the spacer separate from the heat transfer tube 60 to the heat transfer tube 60, etc.

(2-3-2-2) Second Region

As described above, the second region 66 of the heat transfer tube 60 is an example of the liquid header coupling portion in the claims. The second region 66 of the heat transfer tube 60 is inserted into the liquid header 54, and at least part of the second region 66 of the heat transfer tube 60 is coupled to the liquid header 54.

Unlike the first region 62 of the heat transfer tube 60, the second region 66 of the heat transfer tube 60 does not include concave and convex (enlarged portion and contracted portion) on the outer surface 60*f*. In other words, in the second region 66 of the heat transfer tube 60, the size of the outer edge of the heat transfer tube 60 is uniform. Further, in the second region 66 of the heat transfer tube 60, the size of the inner edge of the heat transfer tube 60 is uniform.

The second region 66 of the heat transfer tube 60 is a portion where the size of the inner edge of the heat transfer tube 60 is formed to be smaller than those of the portions other than the second region 66 of the heat transfer tube 60. Specifically, the size of the inner edge of the heat transfer tube 60 in the second region 66 is smaller than the average size of the inner edges of the heat transfer tube 60 other than the second region 66. Further, as illustrated in FIG. 4, the size of the inner edge of the heat transfer tube 60 in the second region 66 is smaller than the size of the inner edge of the heat transfer tube 60 in the first portion 62*a* of the first region 62. In FIG. 4, the cross-section of the second region 66 is indicated in a solid line, and the cross-section of the first portion 62*a* in the first region 62 of the heat transfer tube 60 is indicated in a dashed-two dotted line.

Furthermore, the second region 66 of the heat transfer tube 60 is a portion where the size of the outer edge of the heat transfer tube 60 is formed to be smaller than those of the portions of the heat transfer tube 60 other than the second region 66. Specifically, the size of the outer edge of the heat transfer tube 60 in the second region 66 is smaller than the average size of the outer edges of the heat transfer tube 60 other than the second region 66. Further, as illustrated in FIG. 4, the size of the outer edge of the heat transfer tube 60 in the second region 66 is smaller than the size of the outer edge of the heat transfer tube 60 in the first portion 62*a* of the first region 62.

<Effect of Providing Second Region>

The effect of providing the second region 66 in the heat transfer tube 60 will be described.

As described above, the second region 66 of the heat transfer tube 60 is formed in the end portion of the heat transfer tube 60 on the side coupled to the liquid header 54. Therefore, the liquid refrigerant primarily flows at the position corresponding to the second region 66 in the refrigerant channel P of the heat transfer tube 60 both when the heat-source heat exchanger 50 functions as a condenser and when the heat-source heat exchanger 50 functions as an evaporator.

Thus, in the heat-source heat exchanger 50 according to one or more embodiments, the second region 66, in which the size of the inner edge of the heat transfer tube 60 is smaller than the sizes of the inner edges of the other portions of the heat transfer tube 60, is provided in the place where the liquid refrigerant primarily flows, which has a smaller volume than the gas refrigerant (in the case of the same mass and the same pressure). As a result, the heat transfer coefficient between the external fluid and the refrigerant (primarily liquid refrigerant) in the second region 66 via the heat transfer tube 60 may be improved.

(2-3-2-3) Third Region

As described above, the third region 68 of the heat transfer tube 60 is an example of the gas header coupling portion in the claims. The third region 68 of the heat transfer tube 60 is inserted into the gas header 52, and at least part of the third region 68 of the heat transfer tube 60 is coupled to the gas header 52.

Furthermore, the third region 68 of the heat transfer tube 60 is an example of the protrusion in the claims. The outer surface 60*f* of the third region 68 of the heat transfer tube 60 protrudes in the direction intersecting with the up-down direction, which is the longitudinal direction of the heat transfer tube 60, with respect to a portion adjacent to the third region 68 of the heat transfer tube 60 (a portion below the third region 68 of the heat transfer tube 60) and is in contact with the outer surface 60*f* of the adjacent heat transfer tube 60. Further, the third region 68 of the heat transfer tube 60 is an example of a first protrusion in the claims, which is provided in an end portion of the heat transfer tube 60 in the up-down direction that is the longitudinal direction of the heat transfer tube 60.

Unlike the first region 62 of the heat transfer tube 60, the third region 68 of the heat transfer tube 60 does not include concave and convex (enlarged portion and contracted portion) on the outer surface 60*f* In the third region 68 of the heat transfer tube 60, the size of the inner edge of the heat transfer tube 60 is uniform. Further, in the third region 68 of the heat transfer tube 60, the size of the outer edge of the heat transfer tube 60 is uniform.

The third region 68 of the heat transfer tube 60 is a portion where the size of the inner edge of the heat transfer tube 60 is formed to be larger than those of the portions other than the third region 68 of the heat transfer tube 60. Specifically, the size of the inner edge of the heat transfer tube 60 in the third region 68 is larger than the average size of the inner edges of the heat transfer tube 60 other than the third region 68. Further, as illustrated in FIG. 6, the size of the inner edge of the heat transfer tube 60 in the third region 68 is larger than the size of the inner edge of the heat transfer tube 60 in the non-contact portion 63 of the first region 62. Further, in FIG. 6, the cross-section of the third region 68 is indicated in a solid line, and the cross-section of the non-contact portion 63 of the first region 62 of the heat transfer tube 60 is indicated in a dashed-two dotted line.

Furthermore, the third region 68 of the heat transfer tube 60 is a portion in which the size of the outer edge of the heat transfer tube 60 is formed to be larger than those of the portions of the heat transfer tube 60 other than the third region 68. Specifically, the size of the outer edge of the heat transfer tube 60 in the third region 68 is larger than the average size of the outer edges of the heat transfer tube 60 other than the third region 68. Further, as illustrated in FIG. 6, the size of the outer edge of the heat transfer tube 60 in the third region 68 is larger than the size of the outer edge of the heat transfer tube 60 in the non-contact portion 63 of the first region 62.

Further, the size of the outer edge of the heat transfer tube 60 in the third region 68 is the same as the size of the outer edge of the heat transfer tube 60 in the contact portion 64 of the first region 62. Further, the maximum width of the heat transfer tube 60 in the third region 68 in the right-left direction is the same as the maximum width of the contact portion 64 of the first region 62 in the right-left direction. Further, the third region 68 of the heat transfer tube 60 is in contact with the third region 68 of the heat transfer tube 60 adjacent thereto in the right-left direction. Although not illustrated, the third region 68 of the heat transfer tube 60 may be provided with a concave portion similar to the concave portion 64*a* of the contact portion 64.

Furthermore, in the longitudinal direction (up-down direction) of the heat transfer tube 60, a length B1 of the third region 68 of the heat transfer tube 60 may be longer than a length B2 of the contact portion 64 of the first region 62 of the heat transfer tube 60 (see FIG. 2). In other words, the length B1, in the up-down direction, of the third region 68 of the heat transfer tube 60, which is an example of the first protrusion provided in the end portion of the heat transfer tube 60 in the up-down direction (the first direction), may be longer than the length B2, in the up-down direction, of the contact portion 64 of the heat transfer tube 60, which is an example of the second protrusion provided in a portion of the heat transfer tube 60 other than the end portion in the up-down direction.

<Effect of Providing Third Region>

The effect of providing the third region 68 in the heat transfer tube 60 will be described.

(a) Suppression of Increase in Pressure Loss in Refrigerant Channel

As described above, the third region 68 of the heat transfer tube 60 is formed in the end portion of the heat transfer tube 60 on the side coupled to the gas header 52. Therefore, the gas refrigerant primarily flows at the position corresponding to the third region 68 in the refrigerant channel P of the heat transfer tube 60 both when the heat-source heat exchanger 50 functions as a condenser and when the heat-source heat exchanger 50 functions as an evaporator.

Thus, in the heat-source heat exchanger 50 according to one or more embodiments, the third region 68 of the heat transfer tube 60, in which the size of the inner edge of the heat transfer tube 60 is larger than the sizes of the inner edges of the other portions of the heat transfer tube 60, is provided in the place where the gas refrigerant primarily flows, which has a larger volume than the liquid refrigerant (in the case of the same mass and the same pressure). As a result, the pressure loss when the refrigerant flows in the third region 68 is easily suppressed.

(b) Adjustment of Arrangement Pitch between Heat Transfer Tubes

As described above, the third region 68 of the heat transfer tube 60 is in contact with the third region 68 of the heat transfer tube 60 adjacent thereto in the right-left direction. As the third regions 68 of the heat transfer tubes 60 are in contact with each other in this manner, the distance between the heat transfer tubes 60 may be adjusted to a predetermined distance. In other words, as the third regions 68 of the heat transfer tubes 60 adjacent to each other in the right-left direction are in contact with each other in the heat-source heat exchanger 50, it is possible to suppress the occurrence of the state where the heat transfer tubes 60 adjacent to each other in the right-left direction excessively approach each other or excessively separate from each other. In short, the third region 68 of the heat transfer tube 60 functions as a spacer that adjusts the arrangement pitch of the heat transfer tubes 60, similarly to the contact portion 64.

Here, in the longitudinal direction (up-down direction) of the heat transfer tube 60, the length B1 of the third region 68 of the heat transfer tube 60 is longer than the length B2 of the contact portion 64 of the heat transfer tube 60. As the length B1 of the third region 68 in the end portion of the heat transfer tube 60 in the longitudinal direction of the heat transfer tube 60 is relatively long in this way, it is easy to ensure a brazing margin between the third region 68 of the heat transfer tube 60 and the gas header 52.

(3) Method for Manufacturing Heat Transfer Tube

An example of the method for manufacturing the heat transfer tube 60 will be described.

To manufacture the heat transfer tube 60, a flat multi-hole tube including none of the first region 62, the second region 66, and the third region 68 is prepared as a material of the heat transfer tube 60. In other words, to manufacture the heat transfer tube 60, a flat multi-hole tube in which the sizes of the outer edge and the inner edge of the heat transfer tube 60 are uniform along the longitudinal direction of the heat transfer tube 60 is provided as a material of the heat transfer tube 60. For example, a flat multi-hole tube having the cross-section identical to that of the first portion 62*a* of the first region 62, but not limited thereto, is prepared as the material of the heat transfer tube 60. Further, the size of the cross-section of the flat multi-hole tube to be prepared may be designed as appropriate.

Dieless drawing processing is performed on the above flat multi-hole tube (material) to form the heat transfer tube 60 including the first region 62, the second region 66, and the third region 68. Specifically, for example, dieless drawing processing is performed on a flat multi-hole tube having the cross-section identical to that of the first portion 62*a* of the first region 62 to thus form the second portion 62*b* (the non-contact portion 63 and the contact portion 64 (including the concave portion 64*a*)) of the first region 62, the second region 66, the third region 68, and the like.

The dieless drawing processing is a processing method in which a material (here, a flat multi-hole tube before processing) is locally heated by a heating unit using a high-frequency induction heating device, a laser heating device, or the like, and the heating unit (i.e., an area heated by the heating unit) is moved relative to the material in the longitudinal direction of the material (the longitudinal direction of the flat multi-hole tube) while a force along the longitudinal direction of the material is applied to a portion of the material heated by the heating unit to cause the material to protrude in a direction intersecting with the longitudinal direction or stretch in the longitudinal direction. In this dieless drawing processing, deformation to increase the size of the outer edge (i.e., compression of the material in the longitudinal direction) also increases the size of the inner edge. Moreover, in this dieless drawing processing, deformation to decrease the size of the outer edge (i.e., stretching of the material in the longitudinal direction) also decreases the size of the inner edge.

The use of dieless drawing processing as the method for processing the heat transfer tube 60 makes it possible to manufacture the heat transfer tube 60 having the above-described shape in a relatively easy manner and in a relatively short time without undergoing a plurality of steps.

Further, to manufacture the heat-source heat exchanger 50, the heat transfer tubes 60 formed by dieless drawing are arranged in a direction orthogonal to the cross-sectional longitudinal direction D1 in a state where both end portions of the heat transfer tubes 60 are aligned, and the end portions thereof are coupled to the gas header 52 and the liquid header 54 in a state where the heat transfer tubes 60 are stacked in the direction orthogonal to the cross-sectional longitudinal direction D1. When the heat transfer tubes 60 are stacked in the direction orthogonal to the cross-sectional longitudinal direction D1, the contact portion 64 and the third region 68 of the heat transfer tube 60 are in contact with the outer surface 60*f* of the heat transfer tube 60 adjacent thereto in the right-left direction (the contact portion 64 and the third region 68 of the heat transfer tube 60 adjacent thereto in the right-left direction), and therefore the distance between the heat transfer tubes 60 (the arrangement pitch of the heat transfer tubes 60) is adjusted to a predetermined distance.

Further, during the dieless drawing processing, as described above, the size of the outer edge and the size of the inner edge of the flat multi-hole tube simultaneously change. However, to process the heat transfer tube 60, a processing method, different from the dieless drawing processing, in which only one of the size of the outer edge or the size of the inner edge is changed may be at least partially used.

(4) Characteristics of Heat-Source Heat Exchanger (4-1)

In the heat-source heat exchanger 50 according to one or more embodiments, the refrigerant channels P extending in the vertical direction are arranged along the right-left direction intersecting with the vertical direction and are arranged along the front-back direction intersecting with the vertical direction and the right-left direction. The vertical direction, the right-left direction, and the front-back direction are examples of the first direction, the second direction, and the third direction in the claims, respectively. The heat-source heat exchanger 50 includes the heat transfer tubes 60 defining the refrigerant channels P. In the heat transfer tube 60, at least one of the size of the outer edge and the size of the inner edge is different between the first position and the second position in the vertical direction.

In the heat-source heat exchanger 50 according to one or more embodiments, at least one of the sizes of the outer edge and the inner edge of the heat transfer tube 60 is changed along the refrigerant channel P. It is therefore possible to improve the efficiency of the heat-source heat exchanger 50 in accordance with the state change of the refrigerant in each of the refrigerant channels P.

In particular, in the heat-source heat exchanger 50 according to one or more embodiments, the size of the outer edge of the heat transfer tube 60 is changed along the longitudinal direction (vertical direction) of the heat transfer tube 60, and concave and convex are provided on the heat transfer tube 60 along the longitudinal direction. As a result, when using the heat-source heat exchanger 50 as an evaporator, a failure, in which frost is uniformly formed over the entire windward-side end portion of the heat transfer tube 60 in the longitudinal direction, the channel of the air supplied to the heat-source heat exchanger 50 is blocked, and the air is not supplied to the downstream side of the heat transfer tube 60, may be suppressed. Please note that, according to one or more embodiments, in the heat-source heat exchanger 50, the air supplied by the heat source fan 18 flows from front to back.

Further, in the heat-source heat exchanger 50 according to one or more embodiments, the size of the outer edge of the heat transfer tube 60 is changed along the longitudinal direction (vertical direction) of the heat transfer tube 60, and part (the contact portion 64 or the third region 68) of the heat transfer tube 60 is in contact with the heat transfer tube 60 adjacent thereto in the right-left direction. As a result, the arrangement pitch of the heat transfer tubes 60 may be adjusted without using a spacer that is a separate member from the heat transfer tube 60.

(4-2)

In the heat-source heat exchanger 50 according to one or more embodiments, the heat transfer tubes 60 defining the refrigerant channels P are flat multi-hole tubes that define a plurality of the refrigerant channels P arranged along the front-back direction.

In the heat-source heat exchanger 50 according to one or more embodiments, the use of the flat multi-hole tubes as the heat transfer tubes 60 enables efficient heat exchange between the refrigerant and the external fluid without using heat transfer fins.

(4-3)

In the heat-source heat exchanger 50 according to one or more embodiments, the heat transfer tube 60 includes the first region 62 in which the first portion 62*a* and the second portion 62*b* are alternately formed along the vertical direction. The second portion 62*b* protrudes in the direction intersecting with the vertical direction with respect to the first portion 62*a*.

In the heat-source heat exchanger 50 according to one or more embodiments, the first portion 62*a* (concave portion) and the second portion 62*b* (convex portion) are alternately provided along the vertical direction so that the heat exchange efficiency in the first region 62 of the heat transfer tube 60 may be improved.

Furthermore, in the heat-source heat exchanger 50 according to one or more embodiments, as the heat transfer tube 60 includes the first region 62 that repeatedly expands and contracts along the vertical direction, it is possible to intensively cause frost formation in the expanded portion (the second portion 62*b*) in the vertical direction of the heat transfer tube 60. Therefore, it is easy to suppress a failure, in which frost is uniformly formed over the entire windward-side end portion of the heat transfer tube 60 in the vertical direction, the channel of the air supplied to the heat-source heat exchanger 50 is blocked, and the air is not supplied to the downstream side of the heat transfer tube 60.

(4-4)

In the heat-source heat exchanger 50 according to one or more embodiments, a first heat transfer tube of the heat transfer tubes 60 and a second heat transfer tube of the heat transfer tubes 60, that are adjacent to each other in the right-left direction, include the first region 62. In the vertical direction, the second portion 62*b* of the first heat transfer tube 60 and the second portion 62*b* of the second heat transfer tube 60 are formed at the identical position.

In the heat-source heat exchanger 50 according to one or more embodiments, as the positions of the second portions 62*b* of the heat transfer tubes 60 adjacent to each other in the right-left direction are identical in the vertical direction, the positions of the first portions 62*a* of the heat transfer tubes 60 adjacent to each other in the right-left direction are also identical in the vertical direction. Therefore, in the heat-source heat exchanger 50, a relatively large gap may be formed between the first portions 62*a* (concave portions) of the adjacent heat transfer tubes 60, and a relatively large channel of the external fluid may be thus ensured.

(4-5)

In the heat-source heat exchanger 50 according to one or more embodiments, the first region 62 is provided at least in the central portion of the heat transfer tube 60 in the vertical direction.

In the heat-source heat exchanger 50 according to one or more embodiments, as a concave and convex structure is disposed along the vertical direction in the central portion of the heat transfer tube 60 in the vertical direction in which heat is primarily exchanged. Therefore, a high heat exchange efficiency may be easily achieved.

(4-6)

The heat-source heat exchanger 50 according to one or more embodiments includes the gas header 52 to which one end of the heat transfer tube 60 is coupled. The heat-source heat exchanger 50 has the configurations (A) and (B) below.

(A) The size of the inner edge of the heat transfer tube 60 in the third region 68 as an example of the gas header coupling portion, coupled to the gas header 52 in the heat transfer tube 60 is larger than the average size of the inner edges of the heat transfer tube 60 other than the third region 68.

(B) The size of the outer edge of the heat transfer tube 60 in the third region 68 coupled to the gas header 52 in the heat transfer tube 60 is larger than the average size of the outer edges of the heat transfer tube 60 other than the third region 68.

As the heat-source heat exchanger 50 according to one or more embodiments has the above-described configurations (A) and (B), in particular, the configuration (A), it is easy to suppress the pressure loss in the third region 68 of the heat transfer tube 60 through which the gas refrigerant primarily flows.

(4-7)

The heat-source heat exchanger 50 according to one or more embodiments includes the liquid header 54 to which one end of the heat transfer tube 60 is coupled. The heat-source heat exchanger 50 has the configurations (C) and (D) below.

(C) The size of the inner edge of the heat transfer tube 60 in the second region 66 as an example of the liquid header coupling portion, coupled to the liquid header in the heat transfer tube 60 is smaller than the average size of the inner edges of the heat transfer tube 60 other than the second region 66.

(D) The size of the outer edge of the heat transfer tube 60 in the second region 66 coupled to the liquid header in the heat transfer tube 60 is smaller than the average size of the outer edges of the heat transfer tube 60 other than the second region 66.

As the heat-source heat exchanger 50 according to one or more embodiments has the above configurations (C) and (D), in particular, the configuration (C), heat transfer between the liquid refrigerant flowing through the third region 68 and the external fluid may be promoted.

(4-8)

In the heat-source heat exchanger 50 according to one or more embodiments, the size of the outer edge of the heat transfer tube 60 in the portion where the first portion 62*a* is formed is larger than the size of the outer edge of the heat transfer tube 60 in the second region 66 of the heat transfer tube 60 coupled to the liquid header 54. The size of the outer edge of the heat transfer tube 60 in the portion where the second portion 62*b* is formed is equal to or smaller than the size of the outer edge of the heat transfer tube 60 in the third region 68 of the heat transfer tube 60 coupled to the gas header 52.

In the heat-source heat exchanger 50 according to one or more embodiments, the size of the outer edge of the heat transfer tube 60 corresponds to the shape corresponding to a change in the state of the refrigerant in the direction in which the refrigerant channel P extends. Therefore, the heat transfer efficiency of the heat-source heat exchanger 50 may be improved and the pressure loss in the heat-source heat exchanger 50 may be reduced.

(4-9)

In the heat-source heat exchanger 50 according to one or more embodiments, the outer surface 60*f* of the heat transfer tube 60 is provided with the protrusion that protrudes in the direction intersecting with the vertical direction and is in contact with the outer surface 60*f* of the heat transfer tube 60 adjacent thereto in the right-left direction. The protrusion includes the contact portion 64 and the third region 68.

In the heat-source heat exchanger 50 according to one or more embodiments, as the heat transfer tube 60 includes the protrusion, the arrangement pitch of the heat transfer tubes 60 adjacent to each other in the right-left direction may be adjusted without providing a spacer that is a different member from the heat transfer tube 60.

Furthermore, in the heat-source heat exchanger 50 according to one or more embodiments, the arrangement pitch of the heat transfer tubes 60 is maintained at an appropriate distance so that it is possible to ensure an appropriate channel of the external fluid between the heat transfer tubes 60 adjacent to each other in the right-left direction, and it is possible to suppress a local decrease in the heat exchange efficiency due to the fact that the channel of the external fluid is not ensured.

(4-10)

In the heat-source heat exchanger 50 according to one or more embodiments, the protrusion (the contact portion 64 and the third region 68) of the heat transfer tube 60 is in contact with the protrusion of the heat transfer tube 60 adjacent thereto in the right-left direction.

In the heat-source heat exchanger 50 according to one or more embodiments, the protrusions are in contact with each other, and thus it is possible to ensure a relatively large channel of the external fluid between the heat transfer tubes 60 adjacent to each other in the right-left direction, and it is possible to suppress a local decrease in the heat exchange efficiency due to the fact that the channel of the external fluid is not ensured.

(4-11)

In the heat-source heat exchanger 50 according to one or more embodiments, the contact portion 64 is provided with the concave portion 64*a* extending along the front-back direction. Furthermore, the third region 68 of the heat transfer tube 60 is also provided with a concave portion (not illustrated) extending along the front-back direction.

In the heat-source heat exchanger 50 according to one or more embodiments, it is possible to enhance the drainage performance in the contact portion between the heat transfer tubes 60.

(4-12)

The heat-source heat exchanger 50 according to one or more embodiments includes the third region 68, which is an example of the first protrusion, and the contact portion 64, which is an example of the second protrusion, as protrusions in the claims. The third region 68 of the heat transfer tube 60 is provided in the end portion of the heat transfer tube 60 in the vertical direction. The contact portion 64 is provided in a portion of the heat transfer tube 60 other than the end portion in the vertical direction. The length B1 of the third region 68 in the vertical direction is longer than the length B2 of the contact portion 64 in the vertical direction.

In the heat-source heat exchanger 50 according to one or more embodiments, the third regions 68 provided in the end portion of the heat transfer tube 60 in the vertical direction has the relatively long length B1, and therefore it is easy to ensure a brazing margin between the heat transfer tube 60 and the header (in particular, the gas header 52 according to one or more embodiments).

(4-13)

In the heat-source heat exchanger 50 according to one or more embodiments, the heat transfer tube 60 is formed by dieless drawing.

The heat transfer tube 60, in which at least one of the size of the outer edge or the size of the inner edge is different between the first position and the second position in the longitudinal direction of the heat transfer tube 60 in the heat-source heat exchanger 50 according to one or more embodiments, may be manufactured in a relatively easy manner and in a relatively short time, and therefore desired manufacturability is achieved.

Second Embodiments

Figure 9:
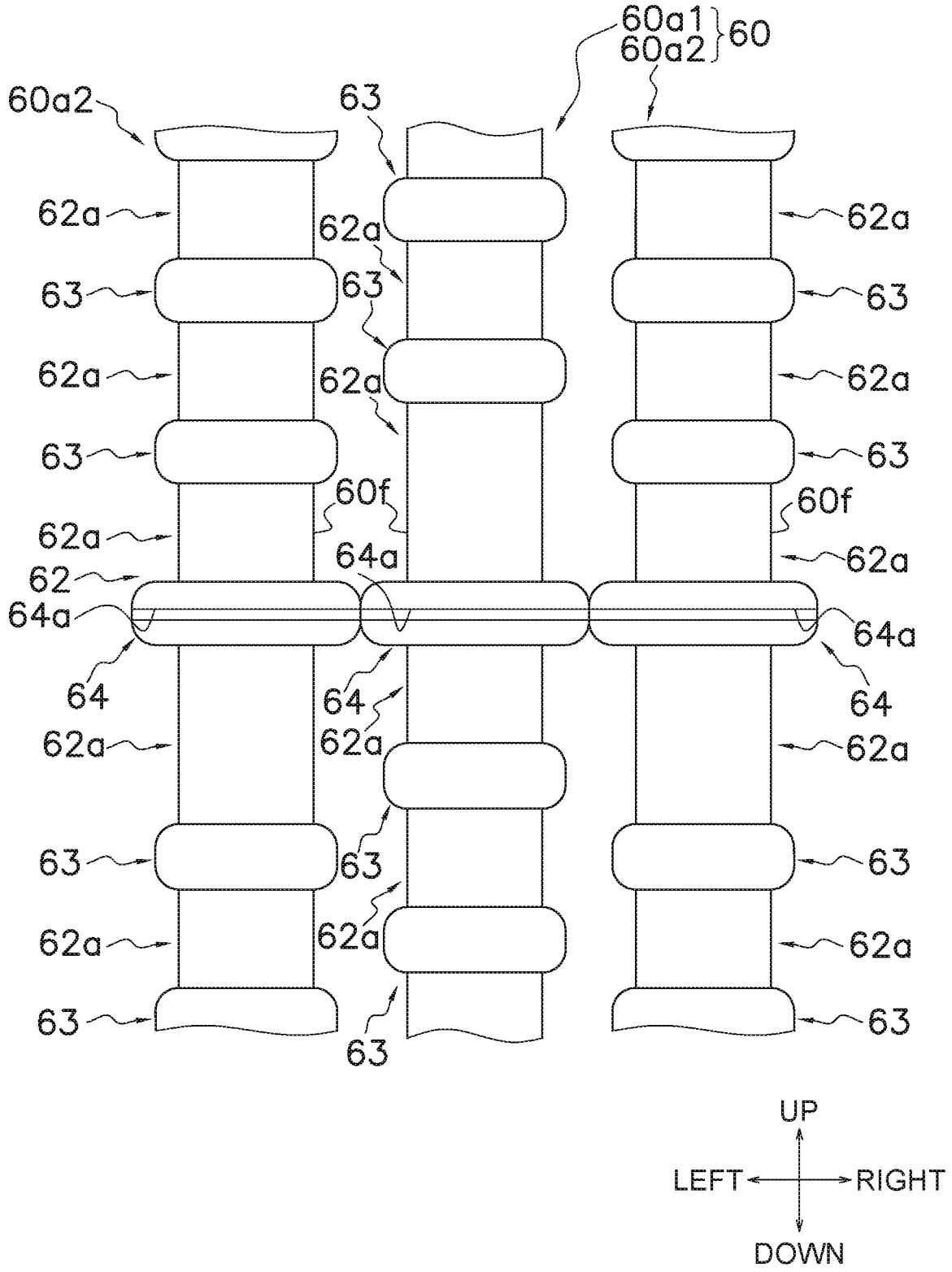
FIG. 9 is an enlarged schematic front view of part of the heat-source heat exchanger to illustrate the contact state between heat transfer tubes and the arrangement of the first portion and the second portion in the first region of the heat transfer tubes in the heat-source heat exchanger according to second embodiments.

The heat-source heat exchanger 50 according to the second embodiments of the heat exchanger of the present disclosure will be described with reference to FIG. 9. FIG. 9 is an enlarged schematic front view of part of the heat-source heat exchanger 50 to illustrate the contact state between the heat transfer tubes 60 (60*a*1, 60*a*2) and the arrangement of the first portion 62*a* and the second portion 62*b* (the non-contact portion 63, the contact portion 64) in the first region 62 of the heat transfer tubes 60*a*1, 60*a*2 in the heat-source heat exchanger 50 according to the second embodiments.

The air conditioning apparatus 100 using the heat-source heat exchanger 50 according to the second embodiments is similar to the air conditioning apparatus 100 described according to the first embodiments, and therefore the description thereof will be omitted. Further, the heat-source heat exchanger 50 according to the second embodiments is substantially the same as the heat-source heat exchanger 50 according to the first embodiments except that the non-contact portions 63 are formed at different positions in the heat transfer tubes 60*a*1, 60*a*2 adjacent to each other in the right-left direction. Therefore, in order to avoid duplicated descriptions, only primary differences between the heat-source heat exchanger 50 according to the second embodiments and the heat-source heat exchanger 50 according to the first embodiments will be described here.

Here, "60*a*1" and "60*a*2" are used as the reference numerals representing the heat transfer tubes 60 in the heat-source heat exchanger 50 according to the second embodiments. In the heat-source heat exchanger 50, the heat transfer tubes 60*a*1, 60*a*2 are arranged such that the heat transfer tube 60*a*1 and the heat transfer tube 60*a*2 are alternately arranged in the right-left direction, as illustrated in FIG. 9.

In the heat transfer tube 60*a*1 and the heat transfer tube 60*a*2, the first regions 62 are formed at a substantially identical position in the vertical direction. However, in the heat transfer tube 60*a*1 and the heat transfer tube 60*a*2, the non-contact portions 63 are formed at different positions in the vertical direction. Specifically, in the heat transfer tube 60*a*2, the first portion 62*a* is provided at the position of the non-contact portion 63 in the vertical direction in the heat transfer tube 60*a*1. Further, in the heat transfer tube 60*a*2, the non-contact portion 63 is provided at the position of the first portion 62*a* in the vertical direction in the heat transfer tube 60*a*1. In the other respects, the heat transfer tube 60*a*1 and the heat transfer tube 60*a*2 are similar.

In short, in the heat-source heat exchanger 50 according to the second embodiments, both the first heat transfer tube 60*a*1 and the second heat transfer tube 60*a*2 adjacent to each other in the right-left direction include the first region 62. In the vertical direction, the non-contact portion 63 of the first heat transfer tube 60*a*1 and the first portion 62*a* of the second heat transfer tube 60*a*2 are formed at the identical position, and the first portion 62*a* of the first heat transfer tube 60*a*1 and the non-contact portion 63 of the second heat transfer tube 60*a*2 are formed at the identical position.

In the heat-source heat exchanger 50 according to the second embodiments, the position of the non-contact portion 63 of the heat transfer tube 60*a*1, 60*a*2 matches the position of the first portion 62*a* of the heat transfer tube 60*a*2, 60*a*1 adjacent in the right-left direction so that a relatively large gap may be formed between the non-contact portion 63 of the heat transfer tube 60*a*1, 60*a*2 and the heat transfer tube 60*a*2, 60*a*1 adjacent in the right-left direction. Therefore, a relatively large channel of the external fluid may be ensured between the heat transfer tubes 60*a*1, 60*a*2 adjacent in the right-left direction.

In addition to the characteristics described here, the heat-source heat exchanger 50 according to the second embodiments has the characteristics similar to (4-1) to (4-3) and (4-5) to (4-13) described as the characteristics of the heat-source heat exchanger 50 according to the first embodiments.

Third Embodiments

Figure 10:
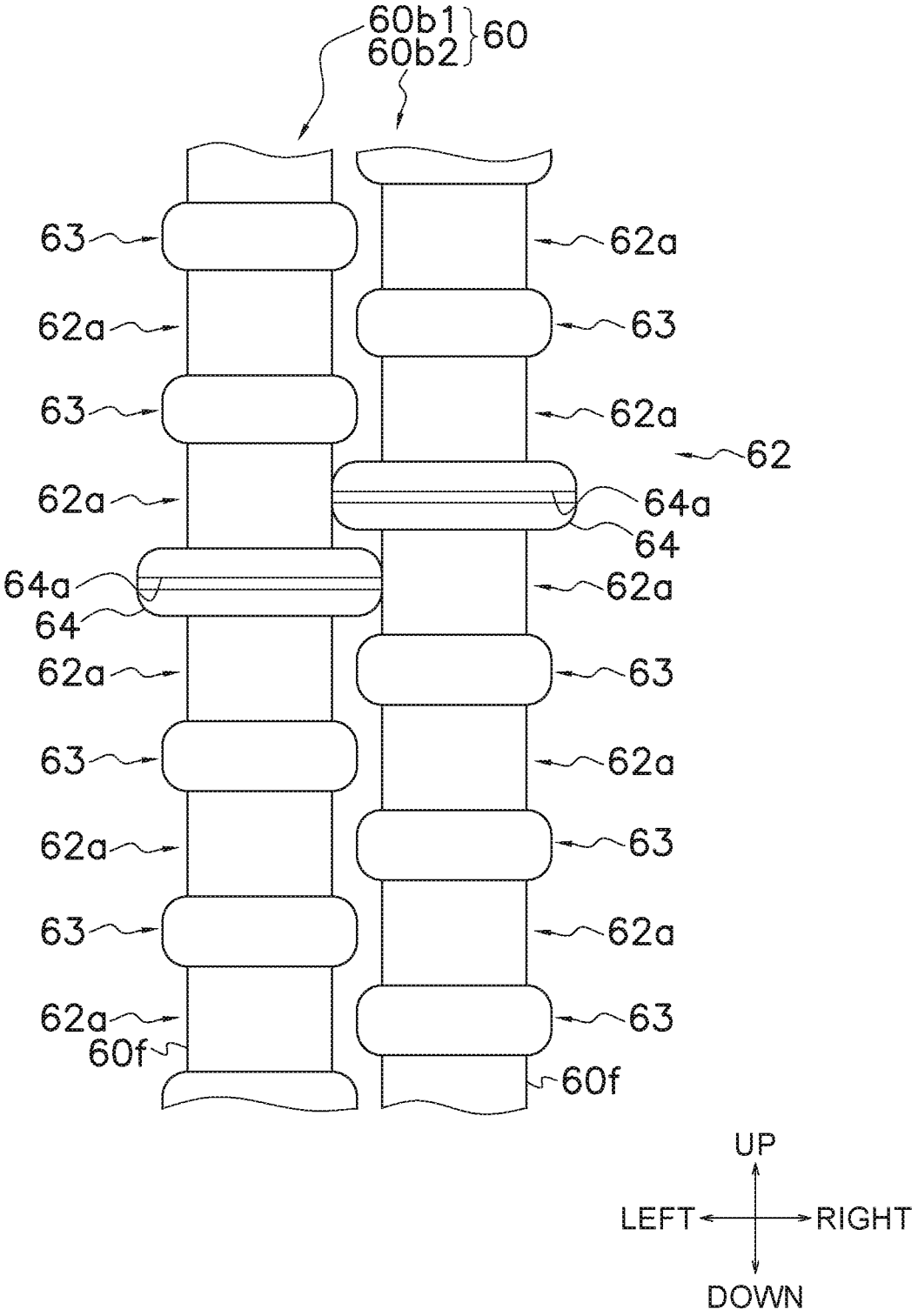
FIG. 10 is an enlarged schematic front view of part of the heat-source heat exchanger to illustrate the contact state between heat transfer tubes and the arrangement of the first portion and the second portion in the first region of the heat transfer tubes in the heat-source heat exchanger according to third embodiments.

The heat-source heat exchanger 50 according to third embodiments of the heat exchanger of the present disclosure will be described with reference to FIG. 10. FIG. 10 is an enlarged schematic front view of part of the heat-source heat exchanger 50 to illustrate the contact state between the heat transfer tubes 60 (60*b*1, 60*b*2) and the arrangement of the first portion 62*a* and the second portion 62*b* (the non-contact portion 63, the contact portion 64) in the first region 62 of the heat transfer tubes 60*b*1, 60*b*2 in the heat-source heat exchanger 50 according to the third embodiments.

The air conditioning apparatus 100 using the heat-source heat exchanger 50 according to the third embodiments is similar to the air conditioning apparatus 100 described according to the first embodiments, and therefore the description thereof will be omitted. Further, the heat-source heat exchanger 50 according to the third embodiments is substantially the same as the heat-source heat exchanger 50 according to the first embodiments except that the non-contact portion 63 and the contact portion 64 are formed at different positions in the heat transfer tubes 60*b*1, 60*b*2 adjacent to each other in the right-left direction. Therefore, in order to avoid duplicated descriptions, only primary differences between the heat-source heat exchanger 50 according to the third embodiments and the heat-source heat exchanger 50 according to the first embodiments will be described here.

Here, "60*b*1" and "60*b*2" are used as the reference numerals representing the heat transfer tubes of the heat-source heat exchanger 50 according to the third embodiments. In the heat-source heat exchanger 50, the heat transfer tubes 60*b*1, 60*b*2 are arranged such that the heat transfer tube 60*b*1 and the heat transfer tube 60*b*2 are alternately arranged in the right-left direction, as illustrated in FIG. 10.

In the heat transfer tube 60*b*1 and the heat transfer tube 60*b*2, the first region 62 is formed at a substantially identical position in the vertical direction. However, in the heat transfer tube 60*b*1 and the heat transfer tube 60*b*2, the non-contact portion 63 and the contact portion 64 are formed at different positions in the vertical direction. Specifically, in the heat transfer tube 60*b*2, the first portions 62*a* are provided at the positions of the non-contact portion 63 and the contact portion 64 in the vertical direction in the heat transfer tube 60*b*1. Furthermore, in the heat transfer tube 60*b*2, the non-contact portion 63 or the contact portion 64 is provided at the position of the first portion 62*a* in the vertical direction in the heat transfer tube 60*b*1. In the other respects, the heat transfer tube 60*b*1 and the heat transfer tube 60*b*2 are similar.

In short, in the heat-source heat exchanger 50 according to the third embodiments, both the first heat transfer tube 60*b*1 and the second heat transfer tube 60*b*2 adjacent to each other in the right-left direction include the first region 62. In the vertical direction, the non-contact portion 63 and the contact portion 64 of the first heat transfer tube 60*b*1 and the first portion 62*a* of the second heat transfer tube 60*b*2 are formed at the identical position, and the first portion 62*a* of the first heat transfer tube 60*b*1 and the non-contact portion 63 and the contact portion 64 of the second heat transfer tube 60*b*2 are formed at the identical position.

In the heat-source heat exchanger 50 according to the third embodiments, the position of the non-contact portion 63 of the heat transfer tube 60*b*1, 60*b*2 matches the position of the first portion 62*a* of the heat transfer tube 60*b*2, 60*b*1 adjacent in the right-left direction so that a relatively large gap may be formed between the non-contact portion 63 of the heat transfer tube 60*b*1, 60*b*2 and the heat transfer tube 60*b*2, 60*b*1 adjacent thereto in the right-left direction. Therefore, a relatively large channel of the external fluid may be ensured between the heat transfer tubes 60*b*1, 60*b*2 adjacent to each other in the right-left direction.

Furthermore, in the heat-source heat exchanger 50 according to the third embodiments, the contact portion 64, which is an example of the protrusions of the heat transfer tube 60*b*1, 60*b*2, is in contact with a portion of the heat transfer tube 60*b*2, 60*b*1 adjacent in the right-left direction other than the contact portion 64. Specifically, in the heat-source heat exchanger 50 according to the third embodiments, the contact portion 64 of the heat transfer tube 60*b*1, 60*b*2 is in contact with the first portion 62*a* of the heat transfer tube 60*b*2, 60*b*1 adjacent in the right-left direction.

In the heat-source heat exchanger 50 according to the third embodiments, the contact portion 64 of the heat transfer tube 60*b*1, 60*b*2 is in contact with a portion of the heat transfer tube 60*b*2, 60*b*1 other than the contact portion 64, and therefore the compact heat-source heat exchanger 50 may be easily achieved as compared with the case where the protrusions of the heat transfer tubes are in contact with each other.

Further, in addition to the characteristics described here, the heat-source heat exchanger 50 according to the third embodiments has the characteristics similar to (4-1) to (4-3), (4-5) to (4-9), and (4-11) to (4-13) described as the characteristics of the heat-source heat exchanger 50 according to the first embodiments.

Fourth Embodiments

Figure 11:
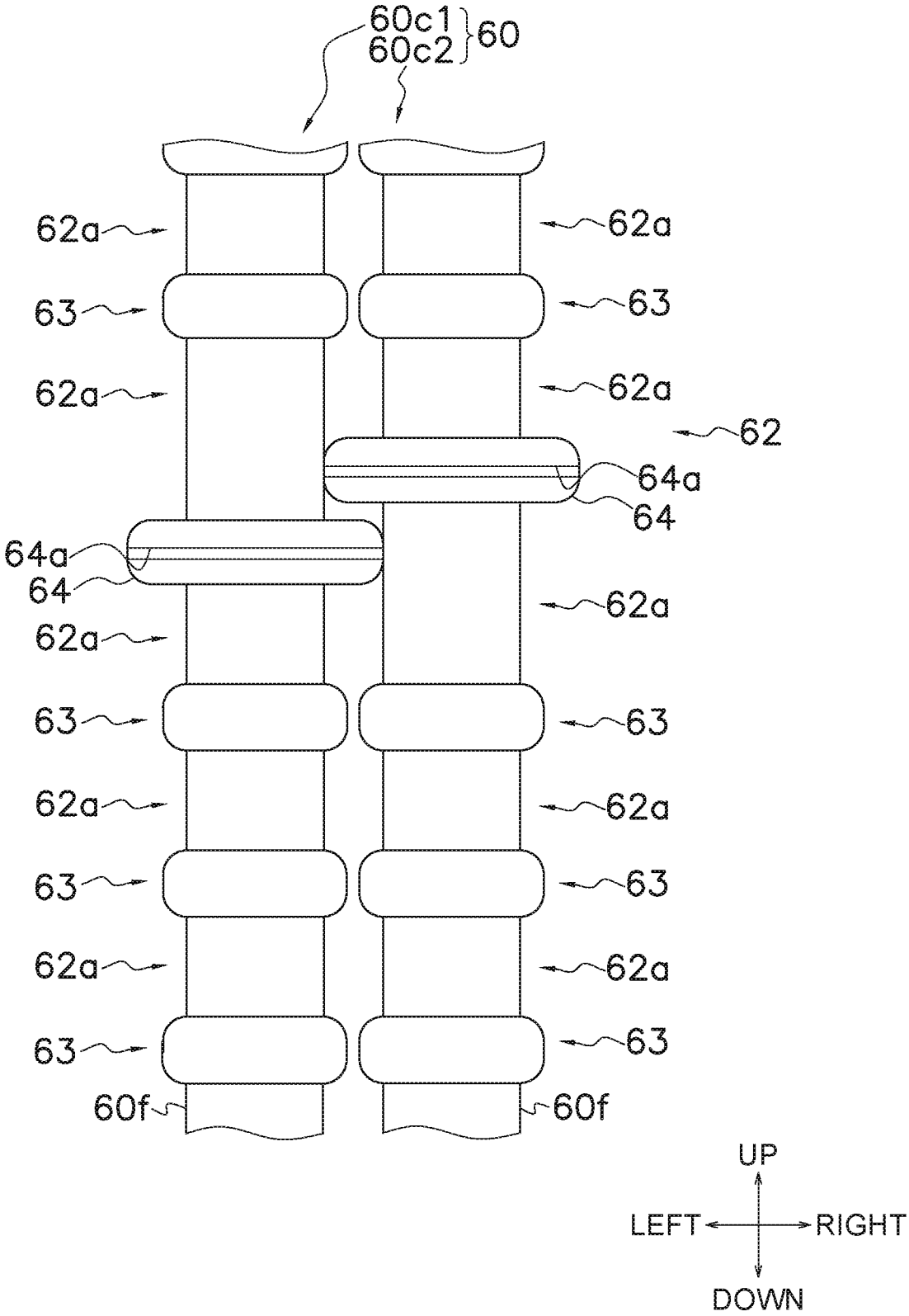
FIG. 11 is an enlarged schematic front view of part of the heat-source heat exchanger to illustrate the contact state between the heat transfer tubes and the arrangement of the first portion and the second portion in the first region of the heat transfer tubes in the heat-source heat exchanger according to fourth embodiments.

The heat-source heat exchanger 50 according to fourth embodiments of the heat exchanger of the present disclosure will be described with reference to FIG. 11. FIG. 11 is an enlarged schematic front view of part of the heat-source heat exchanger 50 to illustrate the contact state between the heat transfer tubes 60 (60*c*1, 60*c*2) and the arrangement of the first portion 62*a* and the second portion 62*b* (the non-contact portion 63, the contact portion 64) in the first region 62 of the heat transfer tubes 60*c*1, 60*c*2 in the heat-source heat exchanger 50 according to the fourth embodiments.

The air conditioning apparatus 100 using the heat-source heat exchanger 50 according to the fourth embodiments is similar to the air conditioning apparatus 100 described according to the first embodiments, and therefore the description thereof will be omitted. Further, the heat-source heat exchanger 50 according to the fourth embodiments is substantially the same as the heat-source heat exchanger 50 according to the first embodiments except that the contact portions 64 are formed at different positions in the heat transfer tubes 60*c*1, 60*c*2 adjacent to each other in the right-left direction. Therefore, in order to avoid duplicated descriptions, only primary differences between the heat-source heat exchanger 50 according to the fourth embodiments and the heat-source heat exchanger 50 according to the first embodiments will be described here.

Here, "60*c*1" and "60*c*2" are used as the reference numerals representing the heat transfer tubes of the heat-source heat exchanger 50 according to the fourth embodiments. In the heat-source heat exchanger 50, the heat transfer tubes 60*c*1, 60*c*2 are arranged such that the heat transfer tube 60*c*1 and the heat transfer tube 60*c*2 are alternately provided in the right-left direction, as illustrated in FIG. 11.

Furthermore, in the heat transfer tube 60*c*1 and the heat transfer tube 60*c*2, the first regions 62 are formed at a substantially identical position in the vertical direction. However, in the heat transfer tube 60*c*1 and the heat transfer tube 60*c*2, the contact portions 64 are formed at different positions in the vertical direction. Specifically, in the heat transfer tube 60*c*2, the first portion 62*a* is provided at the position of the contact portion 64 in the vertical direction in the heat transfer tube 60*c*1. Further, in the heat transfer tube 60*c*2, the contact portion 64 is provided at the position of the first portion 62*a* in the vertical direction in the heat transfer tube 60*c*1. In the other respects, the heat transfer tube 60*c*1 and the heat transfer tube 60*c*2 are similar.

In the heat-source heat exchanger 50 according to the fourth embodiments, the contact portion 64, which is an example of the protrusion of the heat transfer tube 60*c*1, 60*c*2, is in contact with a portion of the heat transfer tube 60*c*2, 60*c*1 adjacent in the right-left direction other than the contact portion 64. Specifically, in the heat-source heat exchanger 50 according to the fourth embodiments, the contact portion 64 of the heat transfer tube 60*c*1, 60*c*2 is in contact with the first portion 62*a* of the heat transfer tube 60*c*2, 60*c*1 adjacent in the right-left direction.

In the heat-source heat exchanger 50 according to the fourth embodiments, the contact portion 64 of the heat transfer tube 60*c*1, 60*c*2 is in contact with a portion of the heat transfer tube 60*c*2, 60*c*1 other than the contact portion 64 so that the compact heat-source heat exchanger 50 may be achieved as compared with the case where the protrusions of the heat transfer tubes are in contact with each other.

Furthermore, in addition to the characteristics described here, the heat-source heat exchanger 50 according to the fourth embodiments has the characteristics similar to (4-1) to (4-9) and (4-11) to (4-13) described as the characteristics of the heat-source heat exchanger 50 according to the first embodiments.

Fifth Embodiments

Figure 12:
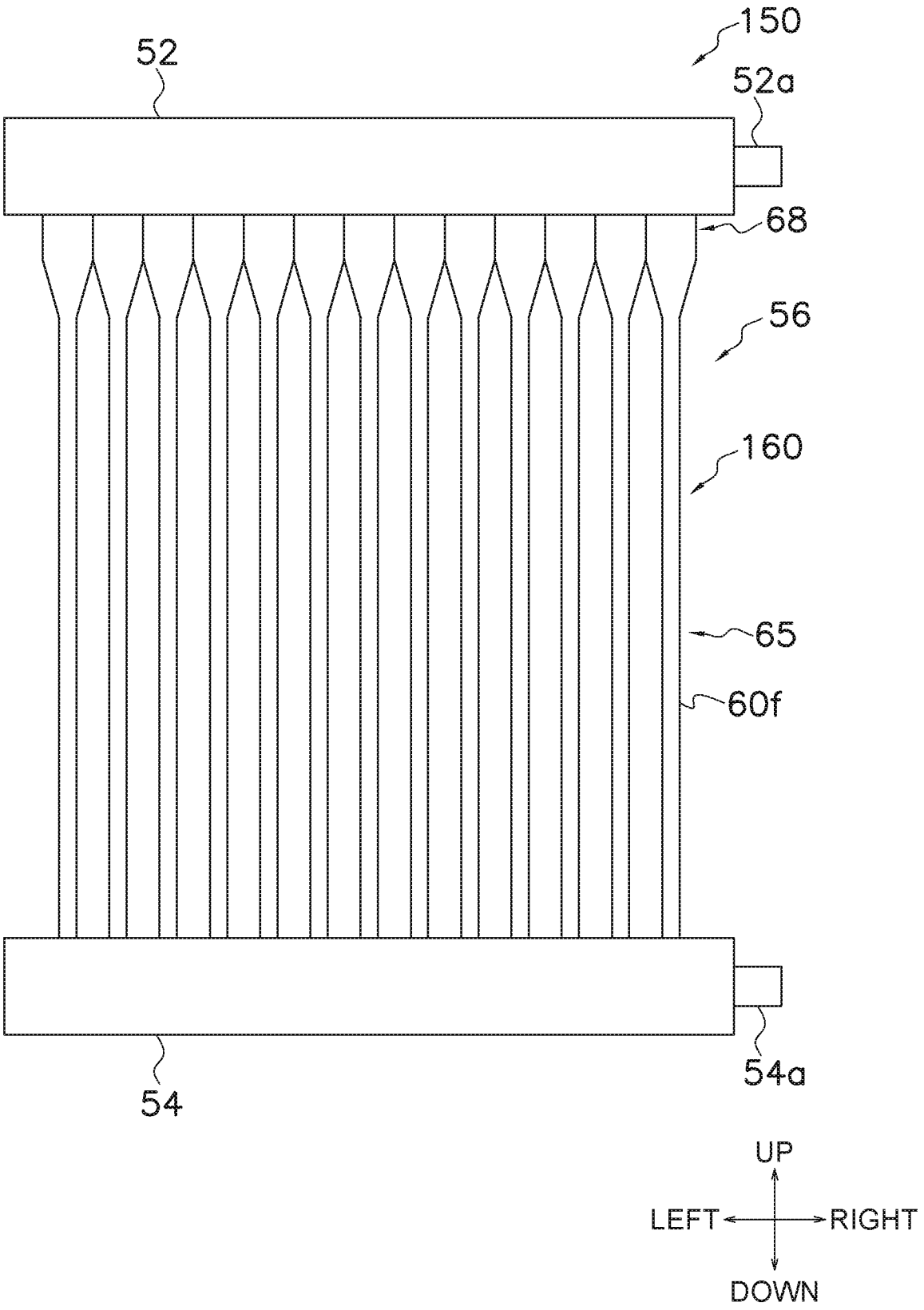
FIG. 12 is a schematic front view of a heat-source heat exchanger according to fifth embodiments.
Figure 13:
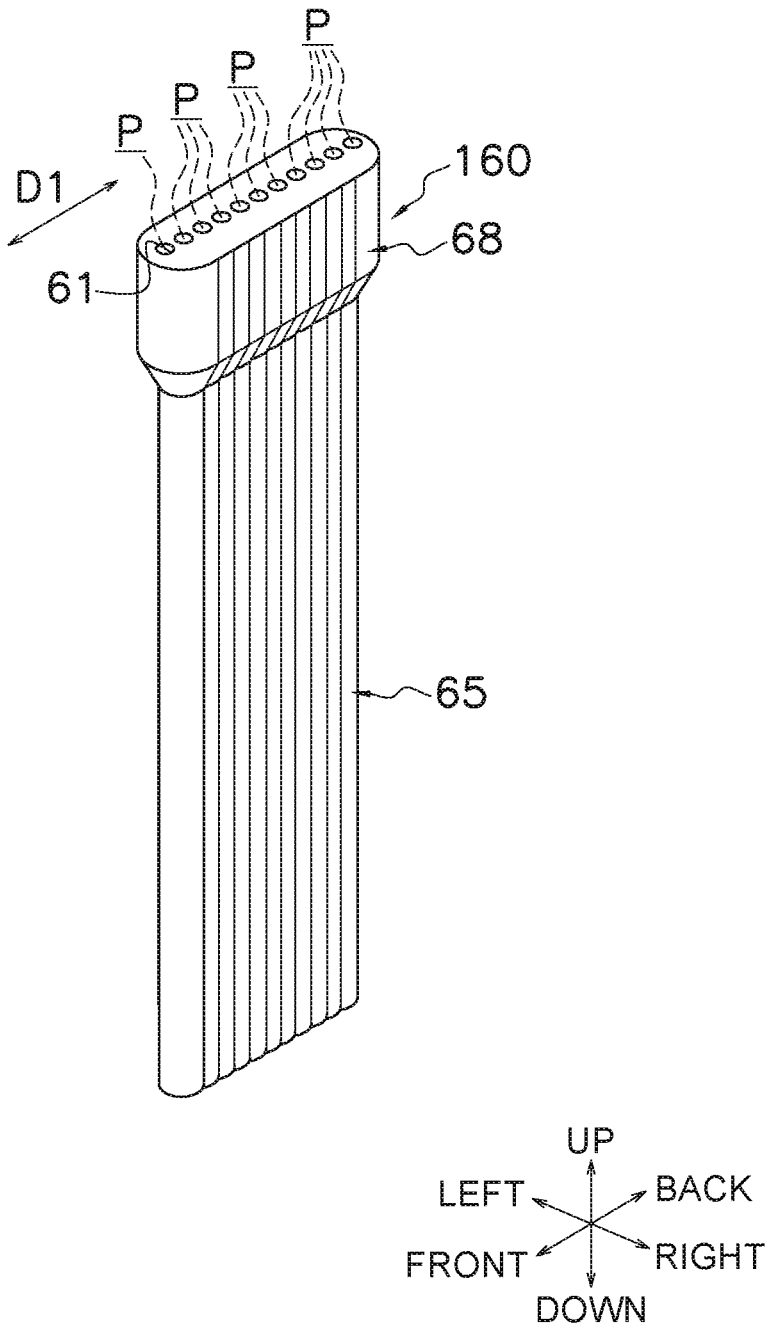
FIG. 13 is a schematic perspective view of a heat transfer tube of the heat-source heat exchanger in FIG. 12.

A heat-source heat exchanger 150 according to fifth embodiments of the heat exchanger of the present disclosure will be described with reference to FIGS. 12 and 13. FIG. 12 is a schematic front view of the heat-source heat exchanger 150 according to the fifth embodiments. FIG. 13 is a schematic perspective view of a heat transfer tube 160 of the heat-source heat exchanger 150.

Further, the air conditioning apparatus 100 using the heat-source heat exchanger 150 according to the fifth embodiments is similar to the air conditioning apparatus 100 described according to the first embodiments, and thus the description thereof will be omitted.

In the heat-source heat exchanger 150 according to the fifth embodiments, the shape of the heat transfer tube 160 is different from the shape of the heat transfer tube 60 of the heat-source heat exchanger 50 according to the first embodiments. Specifically, unlike the heat transfer tube 60, the heat transfer tube 160 does not include the first region 62 and the second region 66, but includes only the third region 68. In a portion other than the third region 68, the sizes of the inner edge and the outer edge of the heat transfer tube 160 are uniform. Here, a portion other than the third region 68 is referred to as a fourth region 65.

In the heat-source heat exchanger 150, in the third region 68 of the heat transfer tube 160, the size of the inner edge of the heat transfer tube 60 is formed to be larger than that of the portion of the heat transfer tube 160 other than the third region 68. Specifically, the size of the inner edge of the heat transfer tube 160 in the third region 68 is larger than the average size of the inner edges of the heat transfer tube 160 in the fourth region 65. Further, in the third region 68 of the heat transfer tube 160, the size of the outer edge of the heat transfer tube 160 is formed to be larger than that of a portion of the heat transfer tube 160 other than the third region 68. Specifically, the size of the outer edge of the heat transfer tube 160 in the third region 68 is larger than the average size of the outer edges of the heat transfer tube 160 in the fourth region 65.

In the other respects, the third region 68 of the heat transfer tube 160 is substantially the same as the third region 68 of the heat transfer tube 60 of the heat-source heat exchanger 50 according to the first embodiments, and therefore the description thereof will be omitted.

In the heat-source heat exchanger 150 according to the present embodiments, the third region 68 provided in the heat transfer tube 160 makes it possible to adjust the arrangement pitch between the heat transfer tubes 160 adjacent in the right-left direction without providing a spacer that is separate member from the heat transfer tube 160. Furthermore, a concave portion (not illustrated) extending along the front-back direction may be formed in the third region 68 of the heat transfer tube 160.

Although not illustrated here, the heat transfer tube 160 may further include the contact portion 64 in the heat transfer tube 60 according to the first embodiments or the contact portion 64 in the heat transfer tube 60 according to the third embodiments. By not only bringing the third regions 68 of the heat transfer tubes 160 into contact with each other, but also providing the contact portion 64 on the outer surface 60*f* of the heat transfer tube 160 that is adjacent to the heat transfer tube 160, it is easy to control the distance between the heat transfer tubes 160 to an appropriate distance in the entire region in the vertical direction. Furthermore, in the heat-source heat exchanger 150, the protrusions are in contact with each other so that it is possible to ensure a relatively large channel of the external fluid between the heat transfer tubes 160 adjacent to each other in the right-left direction, and it is possible to suppress a local decrease in the heat exchange efficiency due to the fact that the channel of the external fluid is not ensured.

Furthermore, in addition to the characteristics described here, the heat-source heat exchanger 50 according to the fourth embodiments has the characteristics similar to (4-1) and (4-2), (4-6), (4-9) to (4-11), and (4-13) described as the characteristics of the heat-source heat exchanger 50 according to the first embodiments.

Sixth Embodiments

Figure 14:
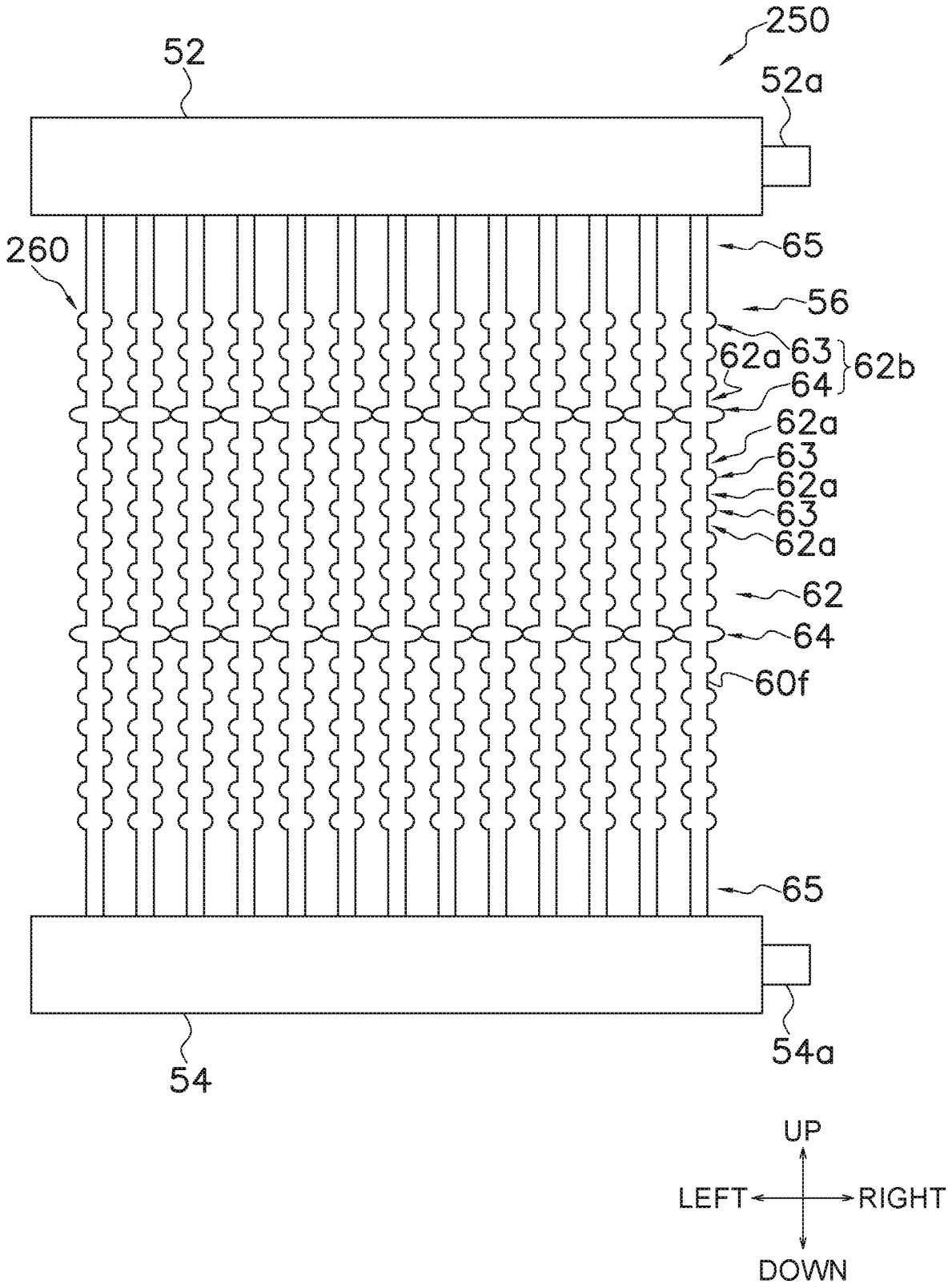
FIG. 14 is a schematic front view of a heat-source heat exchanger according to sixth embodiments.
Figure 15:
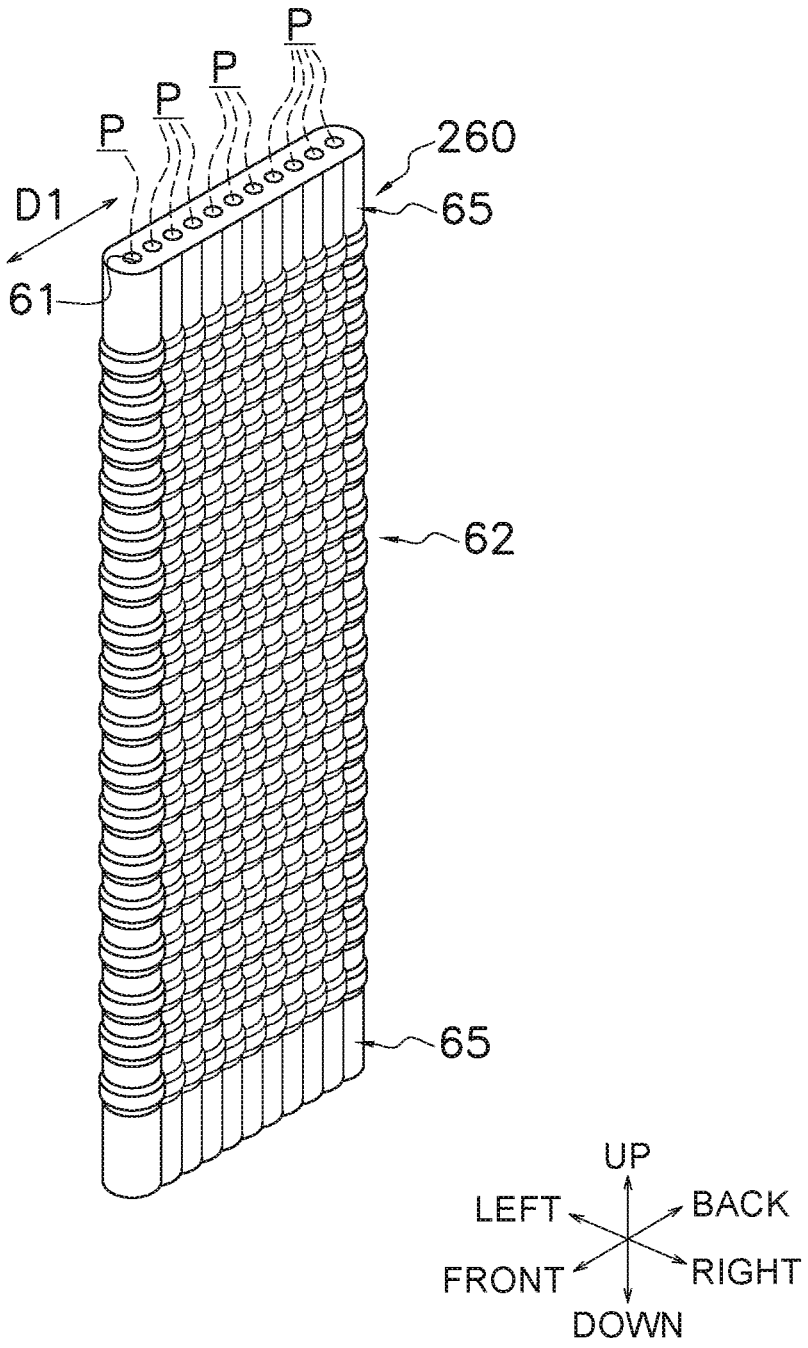
FIG. 15 is a schematic perspective view of a heat transfer tube of the heat-source heat exchanger in FIG. 14.

A heat-source heat exchanger 250 according to sixth embodiments of the heat exchanger of the present disclosure will be described with reference to FIGS. 14 and 15. FIG. 14 is a schematic front view of the heat-source heat exchanger 250 according to the sixth embodiments. FIG. 15 is a schematic perspective view of a heat transfer tube 260 of the heat-source heat exchanger 250.

The air conditioning apparatus 100 using the heat-source heat exchanger 250 according to the sixth embodiments is similar to the air conditioning apparatus 100 described according to the first embodiments, and therefore the description thereof will be omitted.

In the heat-source heat exchanger 250 according to the sixth embodiments, the shape of the heat transfer tube 260 is different from the shape of the heat transfer tube 60 of the heat-source heat exchanger 50 according to the first embodiments. Specifically, unlike the heat transfer tube 60 according to the first embodiments, the heat transfer tube 260 does not include the second region 66 and the third region 68, but includes only the first region 62 described according to the first embodiments. In the heat transfer tube 260, the sizes of the inner edge and the outer edge of the heat transfer tube 260 are uniform in a portion other than the first region 62. Here, the portion other than the first region 62 is referred to as the fourth region 65. Although not limited, the sizes of the inner edge and the outer edge of the heat transfer tube 260 in the fourth region 65 are, for example, the same as the sizes of the inner edge and the outer edge of the heat transfer tube 260 in the first portion 62*a* of the first region 62.

The first region 62 has already been described according to the first embodiments, and therefore the description thereof will be omitted here.

Furthermore, in addition to the characteristics described here, the heat-source heat exchanger 250 according to the sixth embodiments has the characteristics similar to (4-1) to (4-5), (4-9) to (4-11), and (4-13) described as the characteristics of the heat-source heat exchanger 50 according to the first embodiments.

Further, as described above, the heat-source heat exchanger 250 according to the sixth embodiments has a structure in which the second region 66 and the third region 68 are omitted from the heat-source heat exchanger 50 described according to the first embodiments, but is not limited thereto. For example, the heat-source heat exchanger 250 according to the sixth embodiments may have a structure in which the second region 66 and the third region 68 are omitted from the heat-source heat exchanger 50 described according to the second embodiments to the fourth embodiments.

Furthermore, in the heat-source heat exchanger 250 according to the sixth embodiments, the first region 62 may be provided over substantially the entire region in the vertical direction. In other words, in the heat-source heat exchanger 250, the first region 62 of the heat transfer tube 260 may be provided in a range from the vicinity of the coupling portion with the gas header 52 under the gas header 52 to the vicinity of the coupling portion with the liquid header 54 above the liquid header 54.

Seventh Embodiments

Figure 16:
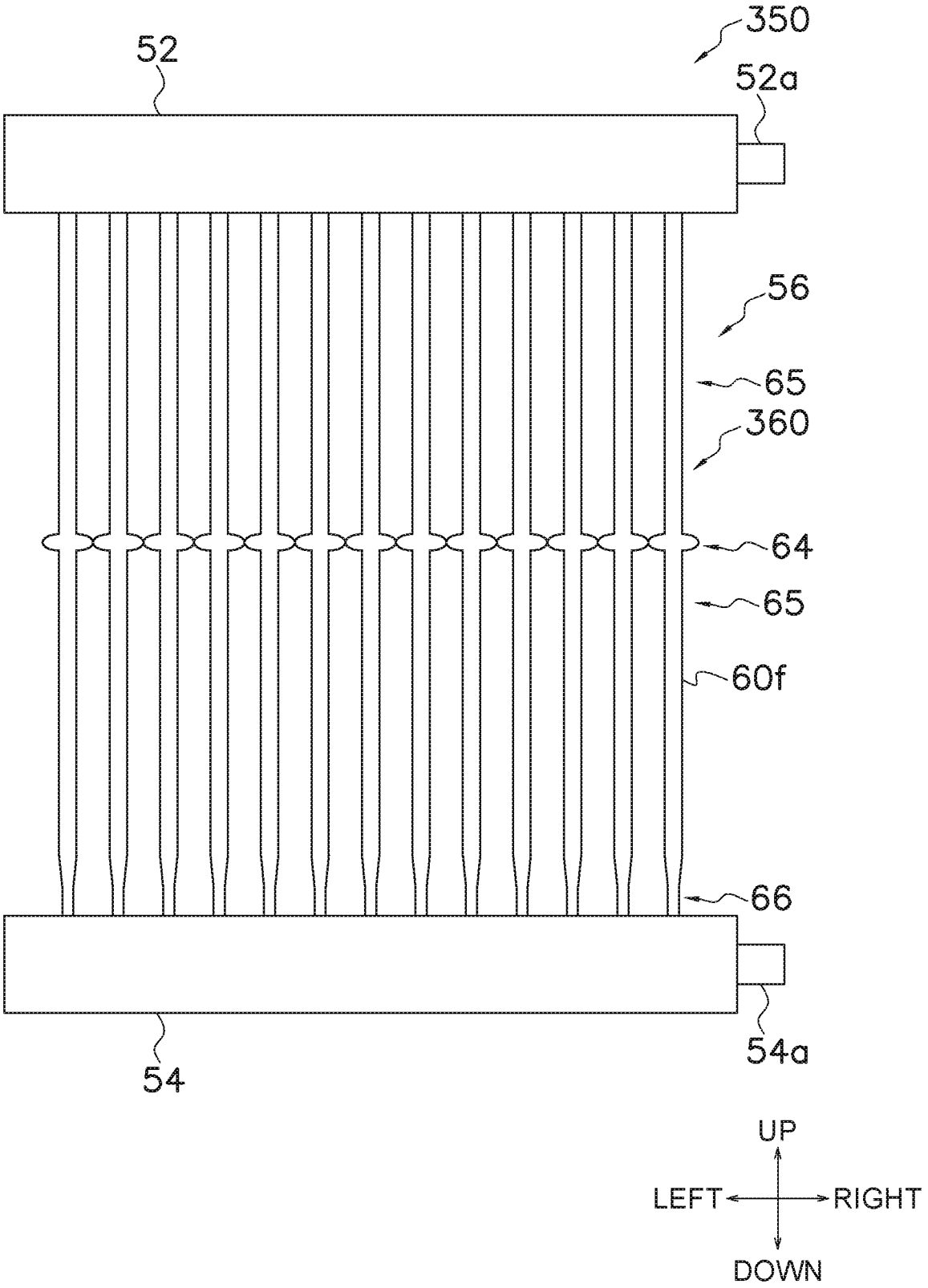
FIG. 16 is a schematic front view of a heat-source heat exchanger according to seventh embodiments.
Figure 17:
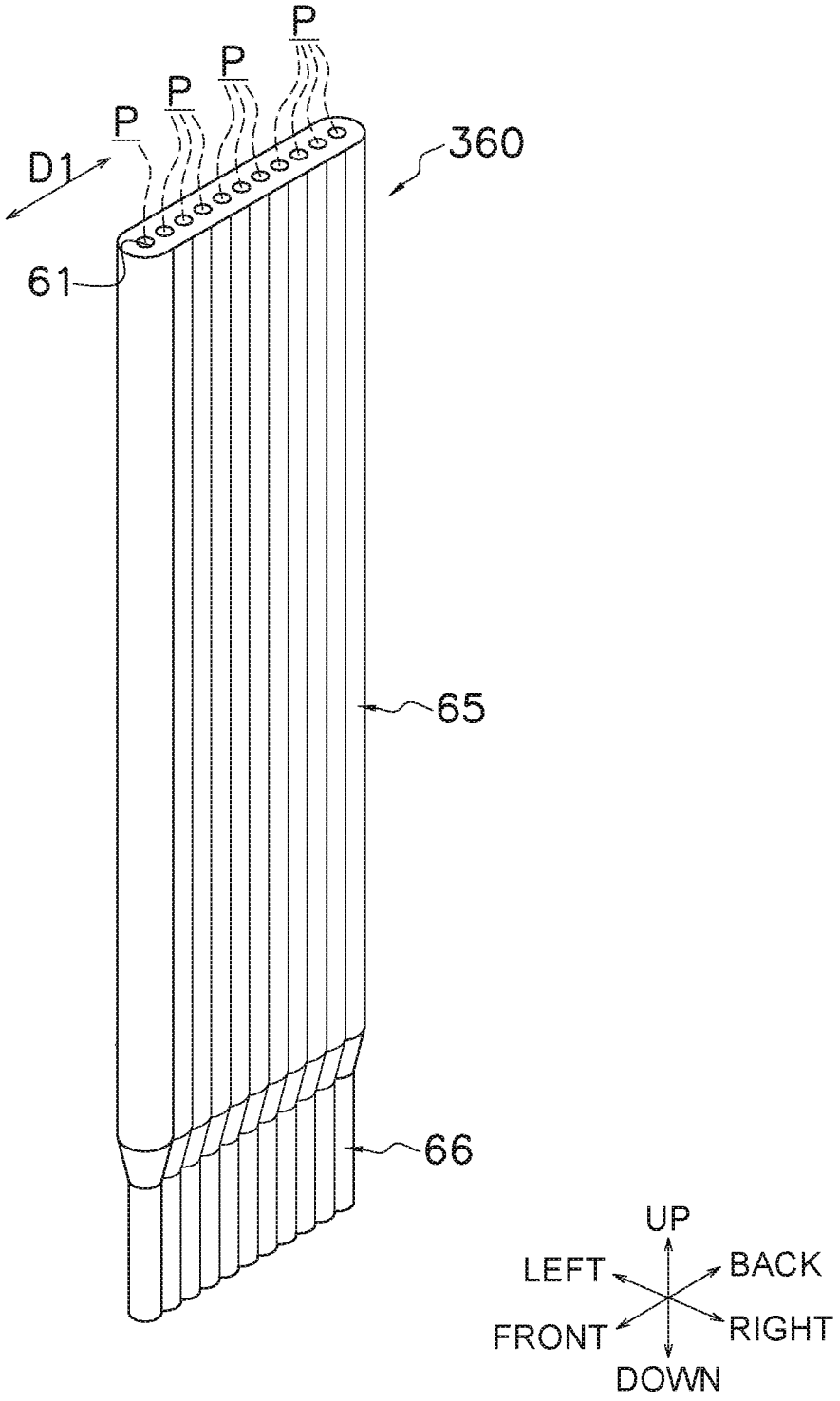
FIG. 17 is a schematic perspective view of a heat transfer tube of the heat-source heat exchanger in FIG. 16.

A heat-source heat exchanger 350 according to seventh embodiments of the heat exchanger of the present disclosure will be described with reference to FIGS. 16 and 17. FIG. 16 is a schematic front view of a heat-source heat exchanger 350 according to the seventh embodiments. FIG. 17 is a schematic perspective view of a heat transfer tube 360 of the heat-source heat exchanger 350. In FIG. 17, the contact portion 64 is not illustrated.

The air conditioning apparatus 100 using the heat-source heat exchanger 350 according to the seventh embodiments is similar to the air conditioning apparatus 100 described according to the first embodiments, and therefore the description thereof will be omitted.

In the heat-source heat exchanger 350 according to the seventh embodiments, the shape of the heat transfer tube 360 is different from the shape of the heat transfer tube 60 of the heat-source heat exchanger 50 according to the first embodiments. Specifically, unlike the heat transfer tube 60, the heat transfer tube 360 does not include the first region 62 and the third region 68, but includes only the second region 66. In a portion other than the second region 66, the sizes of the inner edge and the outer edge of the heat transfer tube 360 are uniform except for the portion where the contact portion 64 is provided. Here, the portion other than the second region 66 is referred to as the fourth region 65.

In the heat-source heat exchanger 350, in the second region 66 of the heat transfer tube 360, the size of the inner edge of the heat transfer tube 360 is formed to be smaller than that of the portion of the heat transfer tube 360 other than the second region 66. Specifically, the size of the inner edge of the heat transfer tube 360 in the second region 66 is smaller than the average size of the inner edges of the heat transfer tube 360 in the fourth region 65. In the second region 66 of the heat transfer tube 360, the size of the outer edge of the heat transfer tube 360 is formed to be smaller than that of the portion of the heat transfer tube 360 other than the second region 66. Specifically, the size of the outer edge of the heat transfer tube 360 in the second region 66 is smaller than the average size of the outer edges of the heat transfer tube 360 in the fourth region 65.

In the other respects, the second region 66 of the heat transfer tube 360 is substantially the same as the second region 66 of the heat transfer tube 60 of the heat-source heat exchanger 50 according to the first embodiments, and therefore the description thereof will be omitted.

Furthermore, in addition to the characteristics described here, the heat-source heat exchanger 350 according to the seventh embodiments has the characteristics similar to (4-1) and (4-2), (4-7), (4-9) to (4-11), and (4-13) described as the characteristics of the heat-source heat exchanger 50 according to the first embodiments.

Eighth Embodiments

Figure 18:
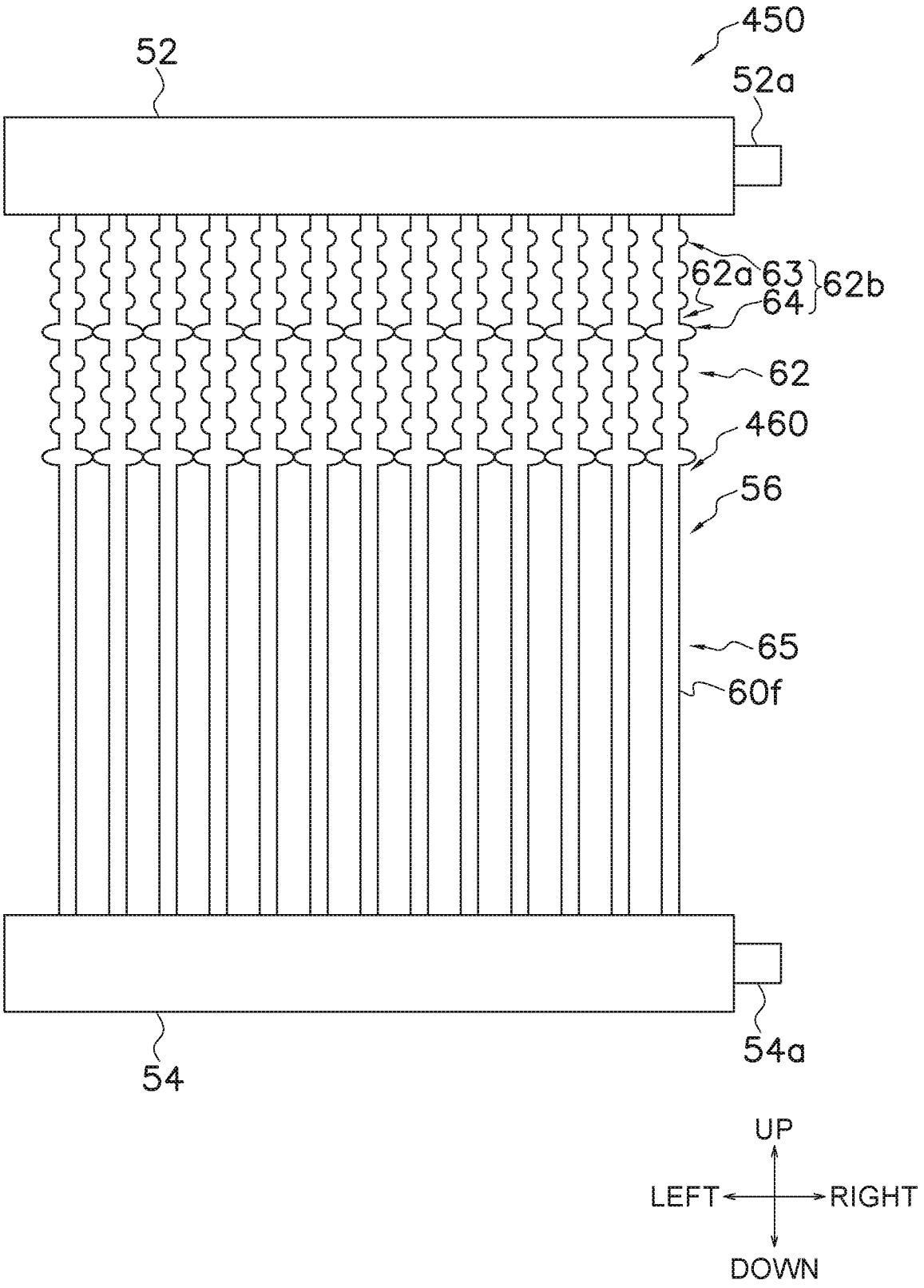
FIG. 18 is a schematic front view of a heat-source heat exchanger according to eighth embodiments.

A heat-source heat exchanger 450 according to eighth embodiments of the heat exchanger of the present disclosure will be described with reference to FIG. 18. FIG. 18 is a schematic front view of the heat-source heat exchanger 450 according to the eighth embodiments.

Furthermore, the air conditioning apparatus 100 using the heat-source heat exchanger 450 according to the eighth embodiments is similar to the air conditioning apparatus 100 described according to the first embodiments, and therefore the description thereof will be omitted.

In the heat-source heat exchanger 450 according to the eighth embodiments, the shape of a heat transfer tube 460 is different from the shape of the heat transfer tube 60 of the heat-source heat exchanger 50 according to the first embodiments. Specifically, unlike the heat transfer tube 60, the heat transfer tube 460 does not include the second region 66 and the third region 68. The heat transfer tube 460 includes the first region 62. However, in the heat-source heat exchanger 450 according to the eighth embodiments, the first region 62 is provided only in the vicinity of the end portion side of the gas header 52 that is the outlet of the heat transfer tube 460 when the heat-source heat exchanger 450 functions as an evaporator (the downstream-side end portion in the flow direction of the refrigerant in the heat transfer tube 460 when the heat-source heat exchanger 450 functions as an evaporator). In a portion other than the first region 62, the sizes of the inner edge and the outer edge of the heat transfer tube 460 are uniform. Here, the portion other than the first region 62 is referred to as the fourth region 65. Although not limited, the sizes of the inner edge and the outer edge of the heat transfer tube 460 in the fourth region 65 are, for example, the same as the sizes of the inner edge and the outer edge of the heat transfer tube 460 in the first portion 62*a* of the first region 62.

Furthermore, the first region 62 of the heat transfer tube 460 of the heat-source heat exchanger 450 according to the eighth embodiments also has the effect of (a) improvement in the heat transfer coefficient and suppression of an increase in pressure loss in the refrigerant channel, but has a large effect of, in particular, (b) suppression of blockage of the air channel due to frost formation, described as the effects of the first region 62 according to the first embodiments.

Specifically, when the heat-source heat exchanger 450 functions as an evaporator, frost formation is likely to occur in the heat transfer tube 460, in particular, at its outlet (the vicinity of the end portion on the gas header 52 side). One of the reasons for this is that the temperature of the gas-liquid two phase refrigerant flowing through the heat transfer tube 460 tends to gradually decrease while flowing through the refrigerant channel P. However, the first region 62 is provided in the vicinity of the outlet of the heat transfer tube 460 (in the vicinity of the end portion on the gas header 52 side) where frost is easily formed, and therefore the effect of the first region 62 described according to the first embodiments may suppress the blockage of the air channel due to frost formation on the windward-side end portion of the heat transfer tube 460 and may delay the occurrence of the failure that the frost formed on the windward-side end portion of the heat transfer tube 460 blocks the air channel.

Furthermore, in addition to the characteristics described here, the heat-source heat exchanger 450 according to the eighth embodiments has the characteristics similar to (4-1) to (4-4), (4-9) to (4-11), and (4-13) described as the characteristics of the heat-source heat exchanger 50 according to the first embodiments.

As the first region 62 of the heat transfer tube 460 of the heat-source heat exchanger 450 according to the eighth embodiments, the first region 62 having the characteristics described in the second embodiments to the fourth embodiments may be provided in the vicinity of the outlet of the heat transfer tube 460.

<Modification>

Although the embodiments of the heat exchanger of the present disclosure have been described above, all or part of the configuration in each of the embodiments may be combined with the configuration of other embodiments as long as there is no contradiction. Modifications of the above-described embodiments will be described below. Further, each modification may be combined with the configuration of another modification as long as there is no contradiction.

(1) Modification A

In the above-described embodiments, the heat transfer tube 60 is a flat multi-hole tube, but the heat transfer tube of the heat exchanger according to the present disclosure may be a circular tube each defining the single refrigerant channel P. Specifically, the heat exchanger according to the present disclosure may be a heat exchanger in which a plurality of circular tubes having its longitudinal direction (the direction in which the refrigerant channel P extends) in the vertical direction is arranged along the right-left direction and are arranged along the front-back direction orthogonal to the vertical direction and the right-left direction.

Even in such a heat exchanger, by making at least one of the size of the outer edge and the size of the inner edge is different between the first position and the second position in the vertical direction of the heat transfer tube, the effect described above may be obtained. For example, by providing any of the first region 62, the second region 66, and the third region 68 is provided in the circular tube, the effects such as improvement in the heat transfer coefficient and reduction in pressure loss described above may be obtained.

Further, in a case where the circular tube has a shape such as the first region 62, when the heat-source heat exchanger 50 is used as an evaporator, as described above, it is easy to suppress a failure that frost is uniformly formed over the entire windward-side end portion of the heat transfer tube in the longitudinal direction, the channel of the air supplied to the heat-source heat exchanger is blocked, and the air is not supplied to the downstream side of the heat transfer tube (blockage of the channel of the air is at least delayed). In a case where the circular tube is used as the heat transfer tube, the first region 62 may be provided only in the heat transfer tube on the upstream side of the air flow from the viewpoint of delaying blockage of the channel of the air due to frost formation.

Furthermore, in a case where the circular tube is provided with a protrusion, such as the contact portion 64 or the third region 68, which is in contact with the heat transfer tube adjacent in the right-left direction, it is possible to adjust the arrangement pitch between the heat transfer tubes without providing a spacer separate from the heat transfer tube. Further, in a case where the circular tube is provided with the contact portion 64 and the third region 68, which protrude also in the front-back direction, the arrangement pitch between the heat transfer tubes in the front-back direction may also be adjusted.

(2) Modification B

According to the above-described embodiments, the gas header 52 and the liquid header 54 extend linearly, but the shapes of the gas header 52 and the liquid header 54 are not limited to linear shapes. The gas header 52 and the liquid header 54 may have a shape other than a linear shape, such as a curved shape, an L-shape, a U-shape, or a square shape.

Further, the heat-source heat exchanger 50 may include two or more sets of the gas headers 52, the liquid headers 54, and the heat exchange units 56.

(3) Modification C

All of the heat transfer tubes included in the heat exchanger according to the present disclosure do not need to have the same shape or the same structure. For example, some of the heat transfer tubes of the heat exchanger may be heat transfer tubes having the shape described according to the first embodiments, and the other heat transfer tubes of the heat exchanger may be heat transfer tubes having a shape other than the shape described according to the first embodiments.

Further, for example, the arrangement pitch of the heat transfer tubes in the heat exchanger do not need to be uniform, and the arrangement pitch of the heat transfer tubes may be different depending on the location.

For example, the specification of each heat transfer tube and the arrangement pitch of the heat transfer tubes are designed as appropriate in accordance with the wind velocity distribution.

(4) Modification D

In the above-described embodiments, the direction in which the refrigerant channel P extends, i.e., the longitudinal direction of the heat transfer tube, is in the vertical direction, but is not limited thereto. For example, the direction in which the refrigerant channel P extends may be inclined with respect to the vertical direction and the horizontal direction. Further, the direction in which the refrigerant channel P extends may be a horizontal direction.

(5) Modification E

In the above-described embodiments, the gas header 52 is provided above, and the liquid header 54 is provided below. Typically, the gas header 52 may be provided above and the liquid header 54 may be provided below. However, this is not a limitation, and the gas header 52 may be provided below the liquid header 54.

(6) Modification F

In the above-described embodiments, the contact portion 64 and the third region 68 adjust the arrangement pitch of the heat transfer tubes adjacent to each other in the right-left direction, but this is not a limitation.

Figure 19:
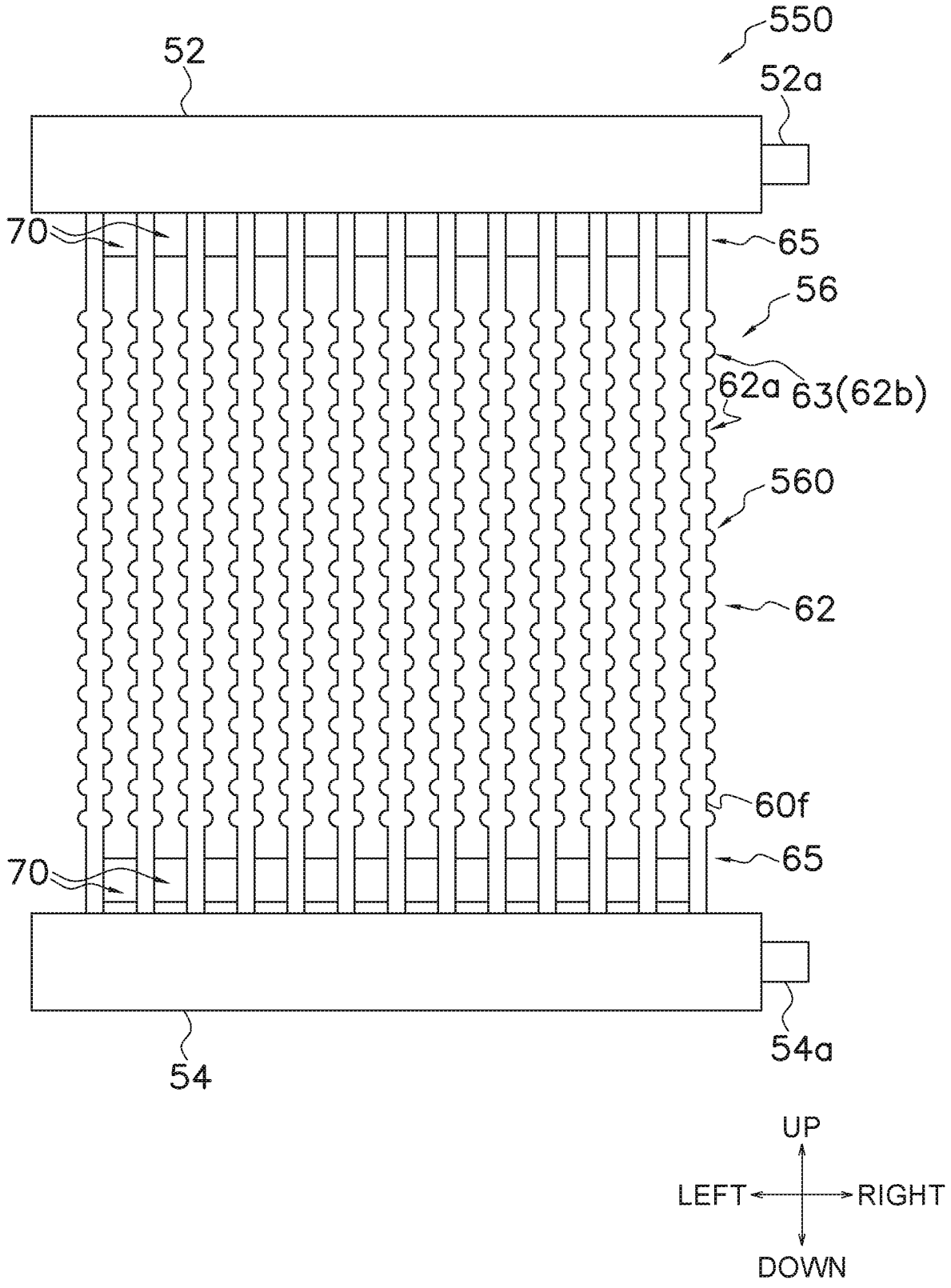
FIG. 19 is a schematic front view of a heat-source heat exchanger according to a modification F.

For example, as in a heat-source heat exchanger 550 illustrated in FIG. 19, a spacer 70 separate from the heat transfer tube 560 may adjust the arrangement pitch between the heat transfer tubes 560 adjacent to each other in the right-left direction.

(7) Modification G

In the heat-source heat exchanger 50 according to the first embodiments, the contact portion 64 is provided in the first region 62 of the heat transfer tube 60, but the contact portion 64 may be formed outside the first region 62, and only the non-contact portion 63 may be formed in the first region 62.

(8) Modification H

In the heat-source heat exchanger 50 according to the first embodiments, all the non-contact portions 63 of the heat transfer tube 60 have the same shape and size in the drawing, but the shapes and sizes of some of the non-contact portions 63 of the heat transfer tube 60 may be different from each other.

(9) Modification I

In the heat-source heat exchanger 50 according to the first embodiments, the contact portion 64 provided in the central region of the heat transfer tube 60 and the third region 68 provided in the end portion on the gas header 52 side of the heat transfer tube 60 are used to adjust the arrangement pitch of the heat transfer tubes 60. However, this is not a limitation, and the protrusion for adjusting the arrangement pitch may be provided in the end portion (the coupling portion with the liquid header 54) of the heat transfer tube 60 on the liquid header 54 side in addition to the central region of the heat transfer tube 60 and the end portion on the gas header 52 side or instead of the central region of the heat transfer tube 60 and the end portion on the gas header 52 side.

Furthermore, from the viewpoint of ensuring a brazing margin, the length of the protrusion, in the longitudinal direction of the heat transfer tube 60, provided in the end portion (the coupling portions with the headers 52, 54) in the longitudinal direction of the heat transfer tube 60 may be longer than the length of the protrusion, in the longitudinal direction of the heat transfer tube 60, provided in a portion of the heat transfer tube 60 other than the end portion in the longitudinal direction.

<Note>

Although the disclosure has been described with respect to only a limited number of embodiments, those skilled in the art, having benefit of this disclosure, will appreciate that various other embodiments may be devised without departing from the scope of the present disclosure. Accordingly, the scope of the disclosure should be limited only by the attached claims.

The present disclosure is widely applicable to heat exchangers that do not use heat transfer fins.

REFERENCE SIGNS LIST

50, 150, 250, 350, 450, 550 Heat-source heat exchanger (Heat exchanger)
52 Gas header
54 Liquid header
60, 160, 260, 360, 460, 560 Heat transfer tube
62 First region
62*a* First portion
62*b* Second portion
64 Contact portion (Protrusion, Second protrusion)
64*a* Concave portion
66 Second region (Liquid header coupling portion)
68 Third region (Gas header coupling portion, Protrusion, First protrusion)
B1 Length of third region in vertical direction (Length of first protrusion in first direction)
B2 Length of contact portion in vertical direction (Length of second protrusion in first direction)
P Refrigerant channel

PATENT LITERATURE

PTL 1: International Publication No. 2005/073655

What is claimed is:

1. A heat exchanger comprising:
refrigerant channels that:
extend in a first direction,
are disposed along a second direction intersecting with the first direction, and
are disposed along a third direction intersecting with the first direction and the second direction; and
heat transfer tubes defining the refrigerant channels, wherein
one or both of a size of an outer edge and a size of an inner edge of the heat transfer tubes are different between a first position and a second position in the first direction,
outer surfaces of the heat transfer tubes each comprise a protrusion that:
protrudes in a direction intersecting with the first direction, and
is in contact with an outer surface of one of the heat transfer tubes adjacent thereto in the second direction,
the protrusion comprises a concave portion extending along the third direction.

2. The heat exchanger according to claim 1, wherein the heat transfer tubes are flat multi-hole tubes defining the refrigerant channels disposed along the third direction.

3. The heat exchanger according to claim 1, wherein the first direction is vertical.

4. The heat exchanger according to claim 1, wherein
the heat transfer tubes each comprise a first region where a first portion and a second portion are alternately disposed along the first direction, and
the second portion protrudes in a direction intersecting with the first direction with respect to the first portion.

5. The heat exchanger according to claim 4, wherein
a first heat transfer tube of the heat transfer tubes and a second heat transfer tube of the heat transfer tubes are adjacent to each other in the second direction,
the first heat transfer tube and the second heat transfer tube each comprise the first region, and
the second portion of the first heat transfer tube and the second portion of the second heat transfer tube are disposed at an identical position in the first direction.

6. The heat exchanger according to claim 4, wherein
a first heat transfer tube of the heat transfer tubes and a second heat transfer tube of the heat transfer tubes are adjacent to each other in the second direction,
the first heat transfer tube and the second heat transfer tube each comprise the first region,
in the first direction, the second portion of the first heat transfer tube and the first portion of the second heat transfer tube are disposed at an identical position, and
the first portion of the first heat transfer tube and the second portion of the second heat transfer tube are disposed at an identical position.

7. The heat exchanger according to claim 4, wherein the first region is disposed at least in a central portion of each of the heat transfer tubes in the first direction.

8. The heat exchanger according to claim 7, further comprising:
a gas header to which the heat transfer tubes are coupled, wherein
one or both of:
the size of the inner edge of the heat transfer tubes in a gas header coupling portion coupled to the gas header in the heat transfer tubes is larger than an average size of the inner edge of the heat transfer tubes other than the gas header coupling portion, and
the size of the outer edge of the heat transfer tubes in a gas header coupling portion coupled to the gas header in the heat transfer tubes is larger than an average size of the outer edge of the heat transfer tubes other than the gas header coupling portion.

9. The heat exchanger according to claim 1, further comprising:
a liquid header to which the heat transfer tubes are coupled, wherein
one or both of:
the size of the inner edge of the heat transfer tubes in a liquid header coupling portion coupled to the liquid header in the heat transfer tubes is smaller than an average size of the inner edge of the heat transfer tubes other than the liquid header coupling portion, and
the size of the outer edge of the heat transfer tubes in the liquid header coupling portion coupled to the liquid header in the heat transfer tubes is smaller than an average size of the outer edge of the heat transfer tubes other than the liquid header coupling portion.

10. The heat exchanger according to claim 4, further comprising:
a gas header to which the heat transfer tubes are coupled; and
a liquid header to which the heat transfer tubes are coupled, wherein
the size of the outer edge of the heat transfer tubes in the first portion is larger than the size of the outer edge of the heat transfer tubes in a liquid header coupling portion coupled to the liquid header in the heat transfer tubes, and
the size of the outer edge of the heat transfer tubes in the second portion is equal to or smaller than the size of the outer edge of the heat transfer tubes in a gas header coupling portion coupled to the gas header in the heat transfer tubes.

11. The heat exchanger according to claim 4, wherein
the heat exchanger is configured to function as at least an evaporator, and
the first region is disposed at least in a downstream-side end portion of the heat transfer tubes in a flow direction of a refrigerant in the heat transfer tubes in a case where the heat exchanger functions as an evaporator.

12. The heat exchanger according to claim 1, wherein the protrusion of each of the heat transfer tubes is in contact with the protrusion of one of the heat transfer tubes adjacent thereto in the second direction.

13. The heat exchanger according to claim 1, wherein the protrusion of each of the heat transfer tubes is in contact with a portion of one of the heat transfer tubes adjacent thereto in the second direction other than the protrusion.

14. The heat exchanger according to claim 1, wherein
the protrusion comprises:
a first protrusion disposed in an end portion of each of the heat transfer tubes in the first direction; and
a second protrusion disposed in a portion of each of the heat transfer tubes other than the end portion in the first direction, and
a length of the first protrusion in the first direction is longer than a length of the second protrusion in the first direction.

15. A method for producing the heat exchanger according to claim 1, comprising:
forming a heat transfer tube by dieless drawing.

16. The heat exchanger according to claim 1, wherein each of the heat transfer tubes comprises a protrusion that protrudes in the second direction as a result of changing a size of the outer edge of the each of the heat transfer tubes.

* * * * *